US008122966B2

(12) United States Patent
Kelley

(10) Patent No.: US 8,122,966 B2
(45) Date of Patent: Feb. 28, 2012

(54) TOTAL IN PLACE HYDROCARBON RECOVERY BY ISOLATED LIQUID AND GAS PRODUCTION THROUGH EXPANDED VOLUMETRIC WELLBORE EXPOSURE +

(76) Inventor: Terry Earl Kelley, Berkeley, CA (US)

( * ) Notice: Subject to any disclaimer, the term of this patent is extended or adjusted under 35 U.S.C. 154(b) by 367 days.

(21) Appl. No.: 12/384,545

(22) Filed: Apr. 6, 2009

(65) Prior Publication Data

US 2010/0252271 A1 Oct. 7, 2010

(51) Int. Cl.
*E21B 43/16* (2006.01)

(52) U.S. Cl. ..... 166/372; 166/370; 166/106

(58) Field of Classification Search ..... 166/370, 166/372, 106

See application file for complete search history.

(56) References Cited

U.S. PATENT DOCUMENTS

| | | | | |
|---|---|---|---|---|
| 3,566,965 | A * | 3/1971 | Solum | 166/241.7 |
| 7,506,690 | B2 * | 3/2009 | Kelley | 166/372 |
| 2007/0000663 | A1 * | 1/2007 | Kelley | 166/268 |

* cited by examiner

*Primary Examiner* — Giovanna Wright

(57) ABSTRACT

Higher volumetric hydrocarbon exposed original or restored by miscible gas injection, solution gas saturated oil is recovered through enlarged expandable liner, sand screened wellbores by controlled wellbore to formation pressure maintained above recovering oils critical bubble point. Exclusively hydrocarbon formation liquids are differential pressure forced through centralizer held larger outer diameter liquid displacer into the production tubing, while maintaining gas volume, pressure, and solution gas saturation in the formation, for higher volume flow for total in place oil recovery. Injected downstructure waterdrive pressure (WDP) into oil or gas formations augments oil and/or gas production and recovery. Complete gas well de-liquefying is attained by flowing gas recovery through enlarged expandable liner and sand screened wellbores and up the wellbore annulus dry, while producing all liquids separately through the larger outer diameter liquid displacer into the production tubing, to be artificial lifted to surface, while waterdrive pressure (WDP) augments natural gas recovery.

19 Claims, 17 Drawing Sheets

TOTAL IN PLACE HYDROCARBON RECOVERY BY ISOLATED LIQUID AND GAS PRODUCTION THROUGH EXPANDED VOLUMETRIC WELLBORE EXPOSURE +

FIELD OF INVENTION

The present invention relates to an obtained increased expanded volumetric exposure area in gaseous or liquid hydrocarbon formations and its sophisticated centralized and increased outside diameter (O.D.) Downhole Liquid Displacer (DLD) tool's wellbore system for recovering total in place crude oil, and/or condensate, while natural gas is maintained in the reservoir for gas drive pressure or produced. The inventions unique separate liquid and gaseous hydrocarbon recovery is benefited by this enlarged volumetric exposed area to in place liquid and/or gaseous hydrocarbons by means of larger O.D. vertical and optional horizontal boreholes, sealed off with an expandable perforated liner, optionally screened from sand influx. This significantly enhanced volumetric exposure area allows for increased volume flow of liquid hydrocarbons and/or liquid free natural gas production for total in place available oil and/or gas recovery, producing total incoming formation liquids exclusively though the present inventions improved centralized and enlarged DLD tool for higher liquid flow production rates from formation to surface

BACKGROUND OF THE INVENTION

The present patent application claims its date of conception from its Provisional Patent Application filed on Apr. 5, 2008, Entitled "Enlarged Volumetric Exposure for Total in Place Oil & Gas Recovery through Liquid Only Inflow". With US Postcard PTO number—61123004.

The present invention is an improvement application to a "Continuation in part" (CIP) to U.S. patent application Ser. No. application to. 10/340,818 above filed Apr. 21, 2006, with US CIP filing Ser. No. 11/408,413, now an issued patent with U.S. Pat. No. 7,506,690 entitled "Enhanced Liquid Hydrocarbon Recovery by Miscible Gas Injection Water Drive". The principal novel improvements it discloses are enlarged wellbores vertical and optionally horizontal and/or deviated for increased volumetric exposure by expandable liners or casing with optional sand screens on the exterior FIG. 4A, and for a larger O.D. downhole liquid displacer (DLD) tool FIGS. 3, 4 & 5, for higher volume and pressure operations and for increased exposure to liquid and gaseous hydrocarbons in their formation FIGS. 6 through 13.

Also a preferred one of the outside centralizer guides shown in FIGS. 14, 15, & 16, or other similar centralizer guides types are added to the outside of the body and screen section on this inventions vertical downhole liquid displacer (DLD) tool to keep this vertical DLD liquid production tool as vertical as possible in the wellbore for its ideal, and best assured operation possible, especially where slightly deviated or crooked wellbores exist above the pay zones.

Concerning the present inventions use of an Expandable liner and sand screen FIG. 4A shows how an expandable liner is installed in the wellbore. Then the vertical DLD tool and production tubing string are installed in the vertical wellbore.

To reduce the loss of diameter each time a new casing string or liner is set Expandables are applied in wellbores in order to reduce the loss of diameter each time a new casing or liner is set, a cold working process has been developed whereby said casing or liner can be expanded by up to 20% in diameter after being run down-hole. For this purpose, an expansion tool that exceeds the inner diameter of the tube by the required amount of expansion is forced through the pipe. This is done either hydraulically, by applying mud pressure, or mechanically, by pulling a cone shaped\tapered expansion tool. The expansion needs to be reliable, when expanding several below the surface. This can be from 30 ft-6,000 ft in length.

Applications can be groups in two main categories; 1) Cased hole and 2) Open hole. Cased hole work is mainly down during the work over or completion phase of a well. The open hole products are used during the drilling period of a well. The products developed and made available now in cased hole that work, are the expandable liner hanger and the cased hole clad. The expandable liner hanger is a product with better thru bore and envisaged higher reliability. The Case hole clad provide a casing patch across a damaged section of casing, or to close off previously perforated casing. This product has two main advantages—minimal through bore loss [basically two times the wall thickness of tubular being expanded] and high pressure integrity performance.

For open hole applications where expandable technology brings real advantages as described in this disclosure these products are available; 1) "open hole liner" and 2) "open hole clads."

Applications of expandable technology exist, for example water shut off, and casing repairs in old wells, but absolutely none of the oil or gas industries prior art that make use of this technology show this inventions downhole liquid displacer tool applications or employ any pressure displacement drive of liquids only inflow from wellbore bottom up to surface, while retaining gas in the formation or producing it separate.

The present invention discloses larger wellbores though expandable liners with optional sand screens on the exterior in liquid or gaseous hydrocarbon reservoirs, for employing its systems and methods for effectively retaining solution gas in place during production of original solution gas saturated oil, and/or for returning indispensable solution gas saturation to in place crude oil depleted of solution gas saturation, by miscible gas injection to pre-planned optimal solution gas saturation, then efficiently recovering that original or returned solution gas saturated crude oil out of it's formation above its critical bubble point pressure for total in place oil recovery. While benefiting the World's environment by eliminating the burning of natural gas to produce oil, which will significantly help eliminate global heating and oil well blowouts through eliminating the flaring of natural gas to the atmosphere. Also both onshore and offshore oil well blowouts will be considerably reduced by not flowing or producing gas with crude oil.

When the present invention is applied in natural gas reservoirs gas production is flowed undisturbed by liquids separately though the wells (tubing to casing) wellbore annulus to surface, while incoming liquids are removed separately downhole though its improved large liquid displacer tool into the production tubing and when needed artificially lifted onto the surface for total in place gaseous and liquid hydrocarbon recovery. Thus both separate oil and/or gas recovery systems substantially benefit from now enlarged Volumetric exposure for both vertical and horizontal boreholes screened from formation sand, to now attain close to total in place crude oil and/or natural gas recovery.

The present invention is also disclosing added outside centralizing guides with expandable ribs, or extended medal ridge, or clip on or push on synthetic material guides (along with all other industry used types) see FIGS. 14, 15, and 16, specially adapted for or special made for this present invention's Downhole Liquid Displacer Tool's outside body, as well as for its outside upper sand screen section (see FIGS. 3

& 5), to guide the tool downhole through the oil or gas wells wellbore, and protect its compressible fragile screen section, and particularly to better hold the tool in efficient vertical place by the pay zone. These important guides are shown in FIGS. 14 through 16, but not on FIGS. 3 though 13 schematic drawings, however are to be considered present. The DLD label on all drawings from FIG. 3 though FIG. 13 is hereafter called the DLD as the tool now has included improved outside centralizer guides The inventions DLD includes an approximant 24 ft. size or longer vertical float and a valve arrangement, and once installed on the production tubing string in the oil or gas well's wellbore bottom remains immersed in the well's downhole surrounding formation liquids. So when the DLD's top open float becomes full of liquid, an open conduit is provided direct from the hydrocarbon reservoir to the producing tubular string. At that time when automatically the liquid is displaced by gas pressure out of the DLD's interior float, the float rises due to its increased buoyancy and its valve closes to prevent the entry of any and all formation and wellbore gas into the producing tubing string.

The inventions DLD thus includes its vertical float cylinder (closed at the bottom and open at the top) activated double valve system (see FIG. 3), which opens when the DLD full of liquid and submerges and becomes buoyant rises and closes when that liquid is displaced by differential gas pressure through its opened double valve into the tubing string. Importantly this flotation system within this DLD is configured to operate in an n vertical or substantially vertical orientation. If the wellbore is deviated up hole above the open hydrocarbon production formation, and thus the bottom operating DLD it may possibly affect it's float and valves successful operation. Thus the novel addition of vertical wellbore adjusting guides on the outside of the DLD tool's body and equally essential on its sand screen's connecting steel collars sections where formation liquids enter the DLD tool's screen (see FIGS. 3, 4, and 5). Thus when the DLD's vertically held float is open, the open float allows liquid to be transmitted by gas pressure within the wellbore from the producing formation upward through the production tubing string which is positioned above the DLD's head and then to be lifted to the surface by pressure differential alone or with most types artificial lift, (preferably fluid operated gas lift valves). Although drawings don't show the centralizer guides, it is now established that one type of another of centralizer guides will be used as required in that type of wellbore. Although the present inventions DLD may be also used without these guides as the wellbore permits, and or it's preferred. Also the DLD's sand screen may be omitted in non-sandy wells where open perforations can be used alternatively. Also its double valve may be omitted for a single valve when feasible. Also its fabrication materials and as its OD size and length may substantially vary according to need. It is usably run with a bull plug on its bottom, but may be run without one as most feasible, for sand settlement etc. In other words the present inventions DLD basic designs may vary according to its required workable function.

Prior to which this invention is an improvement for, the world oil industry at the present recovers crude oil reserves through industry procedures that allow reservoir gas within the formation to flow into the wellbore and to the surface with the oil. This worldwide oil production method loses the majority of what is originally recoverable crude oil as it becomes unrecoverable and devoid of its solution gas which maintains the oil fluid, highly mobile and thus recoverable. As a result due to the crude oil losing its solution gas saturation, that oil becomes viscous and unrecoverable. The present invention discloses and teaches how to permanently transform this industry practice through recovering in place oil for its reservoir into it disclosed enlarged wellbores without loosening its solution gas saturation, being optionally benefited by a surface injected down structure water drive pressure.

The present inventions increased hydrocarbon recovery methods function through its further disclosed methods of increasing borehole sizes though expandable liners and sand screens being permanently set into the highest maximum O.D, size boreholes possible both vertical and horizontal. This is done by "under-reaming" the open hole using an expandable bit which can be "bi-center" or "tri-center".

The expandable casing or liner string which is being run through, hung into and expanded below large sizes of casing from 9⅞ to 11¾ to 13⅜, up to 16-in. then run into the open hole, cemented therein, and expanded by a hydraulic driven solid cone which also expands and permanently seals the expandable hanger into the upper casing string. I.e. the present inventions expandable liners are run through the first string, hung therein, and expanded to an ID close to or the same as the first upper casing string. This process creates what are called "mono-bores" which maintain the same ID to the bottom of the hole.

In vertical maximum O.D. size by the downhole liquid hydrocarbon formation and in horizontal for maximum size O.D. back into the same liquid hydrocarbon formation, which is also drilled to maximum length for recovering solution gas saturated oil above its bubble point pressure, And also for providing a larger volumetric O.D. vertical and horizontal area with an greatly extended horizontal length area for miscible gas injection to return solution gas saturation to in place oil in oil reservoirs.

This same process is applied in natural gas formations for maximum gas recovery, however optionally miscible gas can be injected into problem condensate blocked areas of the producing gas formation. While liquid burdened natural gas formations are immediately liberated from all incoming liquid burdens by the present inventions recovering natural gas though it's wellbore conduit and formation liquids through the present invention's liquid displacer tool though the production tubing string conduit, for total in place recovery of now liquid free natural gas and liquid hydrocarbons respectively. While water is removed and disposed of at the surface.

The prior art sited and present industry practices do not practice nor benefit from the present inventions centralizer guides on the downhole liquid displacer tool and its sand screen section, helping maintain that tool vertical in the lower wellbore by the open hydrocarbon formation for better assured vertical operation.

Or by the present inventions beneficial addition of enlarged volumetrically exposure to hydrocarbons through its enlarged vertical and horizontal boreholes into that hydrocarbon reservoir. Such increased volumetric exposure consisting of increased maximum O.D size boreholes by the formation vertical pay zone, and increased horizontally length and O.D. size boreholes into that same pay zone which are beneficially obtained with expandable liners and screens set along their specially enlarged O.D. borehole walls, as the invention's downhole liquid displacer tool produces and recovers by wellbore to production tubing pressure differential the total in place solution gas saturated oil incoming production above its bubble point pressure, with applied wellbore wellhead to formation gas pressure control methods from that formation for total in place oil gas recovery. Importantly the large O.D. wellbore allow for larger O.D. downhole liquid displacer tools which give that tool a larger O.D. float to now open the float double valves 3/16" pilot valve with a greater downward weight pull, thus opening at higher wellbore pressures, Plus a larger O.D. DLD has a larger O.D. discharge to be above the it opening valve, for better liquid flow upward, thus alimenting the tight friction back drag to liquid flow of the smaller tools small discharge tube, which held back it daily liquid flow production. The larger 6" O.D.DLD is calculated to now handle up to 15,000 bbl a day of oil flow as found in offshore Cantarell Complex of Mexico.

Nor do today's gas production Industry practices nor any prior art benefit from the present invention's producing natural gas flow from maximum O.D. size boreholes and increased horizontally length and O.D. size boreholes for maximum volumetric exposure to in place natural gas, flowing this gas to surface completely free of any liquid burdens in the wellbore by removing all incoming liquid separately though the present inventions liquid displacer tool into the production tubing, where these liquids are plunger lifted by tubing pressure operated gas lift valve injected gas to surface, while optionally miscible gas can be injected into condensate blocked areas of the gas formation to enhance flow of blocked areas for total in place gas recovery.

While absolutely none of the industry prior art using expandable technology, show a downhole liquid displacer use, or any pressure displacement drive of liquid only inflow from wellbore bottom up to surface in crude oil or natural gas wells, while conserving natural or injected gas in the formation for gas drive in oil wells or producing it open flow separate to surface.

The present invention's systems and methods will recover a high percentage of the total in place crude oil in most recovery stage crude oil reservoirs, and almost all total in place gas from natural gas reservoirs. The vital and major improvements of the present invention are hereafter disclosed are urgently needed by the world oil industry that presently recovers only 10-30% of the total in place crude oil, and rarely reaches 40% oil recovery. While natural gas recovery is lower than 60% recovery in very little too average liquid burdened natural gas reservoirs and a considerable amount less recovery in seriously liquid burdened gas reservoirs. The systems, methods, improvements and advantages of the present invention disclosed are very much novel to the industry and are clearly not disclosed in the prior art, and are hereafter disclosed.

SUMMARY OF THE INVENTION

A novel highly effective vertical wellbore centered downhole liquid displacer tool as described in the background above now called the "DLD" is disclosed to absolutely produce liquids only from oil and or natural gas reservoirs.

World oil reserves have from the oil Industries beginning been critically losing solution gas saturation due to the world oil industry's long-established oil producing methods by flowing oil with gas. Thus allowing solution gas break out from the oil, leaving the much greater majority of the World's oil reserves unrecoverable or becoming unrecoverable, often as high as 80%. While in numerous, and particularly in established and/or mature producing natural gas reservoirs, natural gas recovery worldwide is critically decreasing due to incoming liquids (water, oil, and/or condensate) interference or blockage to gas production flow. The present invention gives effectual solutions to these currently threatening world oil and gas supply problems, to now recover very close to total in place oil in average to high gravity oil reservoirs, and total in place natural gas in liquid burdened gas reservoirs by the present invention's addition of maximally increased O.D. size vertical boreholes and increased O.D. size horizontally and length boreholes, lined with expandable liners and sand screens, for significantly increased crude oil and/or natural gas recovery through maximum volumetric exposure. And by producing gas formation liquid hydrocarbons (or waters) and gaseous hydrocarbons though separate conduits to the surface. And by controllably marinating solution gas saturation and gas pressure in crude oil formations. Thus both liquid and gaseous hydrocarbon recovery systems of the present invention benefit from maximum volumetric exposure to liquid and/or gaseous hydrocarbons for increased volumetric recovery from a given formation area at a greater than before augmented production rate.

Designed for total in place crude oil recovery, as needed the present invention also discloses an novel system and method of miscible gas injection, directly into a crude oil formation's in place crude oil, through the wells tubing string and out a sliding sleeve, or down the wells outside major vertical and when present horizontal wellbore annuluses through perforations and/or open borehole deep into the formations existing in place oil at the specific pressure required to enter into solution with that specific type gravity oil at its existing reservoir conditions, in order to provide the most advantageous solution gas saturation for improved and accelerated oil recovery.

If an new or un-produced original oil reservoirs oil is already optionally solution gas saturated then the present invention can recover its total in place oil above it bubble point pressure without its addition of its miscible gas injection procedure, although it can be used for enhanced or even super accelerated oil production and recovery. Thus the present invention's oil production system is for oil recovery from both reservoir conditions; for producing the oil formation's original, or its miscible gas injected solution gas saturated in place oil above its bubble point pressure into the recovery well's controllably maintained vertical wellbore pressure, retaining the oil above its bubble point pressure, (making it like part of the oil formation) thereby preserving its solution gas saturation, where this recovering solution gas saturated oil is then injected by pressure differential through the invention's downhole liquid displacement tool on into that tool's significantly lower pressure production tubing string, where it is lifted to surface by the invention's systems higher wellbore to lower production tubing differential pressure and assisted when needed by its novel artificial lift methods for ongoing and final total in place liquid hydrocarbon recovery from that liquid hydrocarbon reservoir.

Chosen by a reservoir study program selection the present invention can also optionally utilize surface injected down structure water drive pressure to enhance and accelerate this invention's recovery procedure of original, or its newly miscible gas injected solution gas saturated crude oil. The present inventions water drive addition can be optionally applied in some very exceptional or unique natural gas reservoir conditions when specially needed.

The present invention is also used for total in place natural gas production and recovery from natural gas reservoirs, by innovatively producing downhole formation gas flow on by its downhole liquid displacer tool system up the wells wellbore annulus. While the liquid displacer tool recovers all in coming liquids on to surface through its production tubing string. Thus producing natural gas flow separate from any incoming liquids, which both increases gas production and maintains the recovering natural gas free from being burdened by incoming liquids (water, oil or condensate,). Such liquids (which are quite common) would have seriously restricted or held back gas flow in the surface and/or blocked gas formation to wellbore flow. And in many cases "logged in" preventing completely natural gas production. Both situations are present highly serious gas production industry problems Both oil and gas production equipment systems and novel methods are disclosed, that produce these valuable gaseous and liquid hydrocarbons. The gas recovery version producing gas flow and incoming liquids completely separately through separate conduits on to surface. Maintaining the gas formations natural gas production optimally flowing, with its production flow completely undisturbed from water, oil, and/or condensate blockage, for total in place liquid hydrocarbon and natural gas recovery. While the oil recovery version keeps the crude oil highly mobile and fluid, while maintaining solution gas in solution and reservoir gas pressure in place, for total in place crude oil recovery.

Thus in primary oil formations with original solution gas saturated oil, as well as oil formations where this invention's miscible gas injection procedure has been applied to solution gas saturate the oil, the present invention can when practicable and needed, also employ optional surface injected water drive pressure into a pre-selected section of a down structure liquid hydrocarbon formation to create an upward moving water drive pressure in that formation for increasing and maintaining a pressure drive on its up structure in place crude oil. As a result this water drive pressure operates as a constant pressure driving force to boost and improve the in place oil's recovery.

In oil formations where existing in place oil has been depleted of solution gas, the present invention can be applied for the conversion of unrecoverable oil to recoverable oil, by applying its above described systems and methods of both returning highly valuable solution gas saturation to total in place crude oil, and recovering that oil above its bubble point pressure, when that oil is unrecoverable or borderlines being unrecoverable. Particularly in these type reservoirs, after returned solution gas saturation, the invention's optionally injected down structure water drive pressure can substantially benefit a reservoir's newly now more mobile gas saturated oil recovery, by bringing that reservoir a innovative recovery force when outside gas injection into the gas cap is not feasible. Here water drive can replace that lost gas cap drive, for successful in place oil recovery. Conversely this water drive addition can also be used for boosting the production rate of original medium to heaver solution gas saturated oil when feasible and needed.

Accordingly, the present invention discloses that its same miscible gas injection wells, once the oil has reached its optimum solution gas saturation level, are then converted to solution gas saturated oil recovery wells, which is the invention's by far preferred method. However, where in some type reservoirs sometimes preferred and feasible, the present invention can optionally utilize separate miscible gas injection wells, that have can have near-by separate oil recovery wells, but this method is not usually recommended.

The present invention can be applied in the World's many types of crude oil reserve reservoirs, where their present in place oil is still solution gas saturated, and/or where the miscible gas injection procedure can feasibly reenter solution gas into their type gravity oils, by specially drilling new wells and/or re-completing old wells boreholes to accommodate this present inventions expandable liners and sand screen addition, for substantially larger O.D, vertical and horizontal boreholes. And optionally only where needed and feasibly applied this invention's down structure water drive pressure, thus recovering these reservoirs' original or newly solution gas saturated in place oil above its critical bubble point pressures at augmented or optimum production rates, and/or recovering their newly solution gas saturated oil where gas cap pressure is depleted. Having these newly completed larger O.D. wellbores, and this miscible gas reentry and when needed water drive criteria available, both existing wells as well as newly drilled wells Worldwide can be equipped for the invention's oil recovery systems herein described for total in place oil and/or gas recovery.

The present invention's key liquid displacer tool is its downhole "Liquid displacer" tool (hereafter called Downhole Liquid Displacer DLD although labeled as DOLI in the drawing figures) (See FIGS. 3, 4 & 5) which is now appreciably improved on by its centralizers and its new larger O.D. size larger vertical wellbores as allowed now by the present invention. As a result larger liquid displacer tools depending upon final wellbore sizes can now reach improved larger outer & inter O.D. sizes as allowed by a larger O.D. vertical wellbore, for displacing through the production tubing string on toward the surface, the larger volumes of liquid hydrocarbon production now being recovered into the inventions significantly larger boreholes vertical and optionally horizontal.

Also related Downhole Liquid Displacer Tool improvements are made by its now larger O.D. 24' long float. (See FIGS. 3, 4 & 5) Which now by optionally adding float length to it, it creates a larger O.D. and longer float system for added opening weight to its inside valve's 3/16 pilot valve, to be called the extended float system. This larger O.D. extended length cylinder float system can now open at the many higher ranges of wellbore pressures found in the invention's highest oil or gas recovery pressures that may be encountered. For example the now possible 5.5" Downhole Liquid Displacer Tool, can now open at a 1000 psi pressure differential or even a much higher bottom hole pressure when a liquid level is maintained in the production tubing string above it's eternal discharge valve.

As the present invention's larger Downhole Liquid Displacer (See FIGS. 3, 4 & 5) continually unloads incoming liquid hydrocarbons recovery flow, during its continuous cycling intervals just before free gas can enter its open valve, the float cylinder positively closes off to any and all free wellbore or formation gas to prevent its entering the production tubing string. Thus the invention's improved larger O.D. "extended cylinder float system" which, due to its added float weight verses its added buoyancy, allows the liquid injector's float to submerge and open its small port pilot valve at extreme high pressures, leading to high wellbore to tubing pressure differentials across the valve. This added novel feature is also claimed as an improvement which now makes possible larger volumes of liquid production from all most all now considerably larger volumetric size opened boreholes. Recovering much higher area volumes of liquid hydrocarbon production or water accumulation removal, up into the well's production tubing string through the invention's improved downhole liquid Displacer Tool in various levels of excessively high bottomhole pressure oil or gas wells.

The present invention is also applied in natural gas reservoirs for total in place recovery of gas and liquid hydrocarbons (See FIG. 13). In these natural gas recovery scenarios of the present invention gas is open flowed from its downhole opened formation through the producing gas well's wellbore annulus free of all liquid gradients to surface into the gas sales line, while simultaneously all incoming formation liquids enter that same producing gas well's lower wellbore, where these detrimental to gas flow production liquids are displaced by wellbore to production tubing pressure differential through the invention's downhole liquid injection tool into its maintained lower pressure production tubing string, in order to be pressure differential flowed, or efficiently lifted to surface by the present invention's gas lift valve operated plunger lift. Immediate and exclusive removal of incoming liquids from the gas well's wellbore bottom into the production tubing string allows the complete opened gas formation production inter face to freely flow wide-open maximum gas flow production free of any liquid gradients up the wellbore annulus to the surface gas sales line.

In natural gas reservoirs down structure water can be injected form the surface in certain type condition reservoirs to maintain gas above its dew point pressure, where this water drive force significantly accelerates gas flow recovery during the invention's novel separate gas flow and separate liquid removal procedures.

For lifting liquids to surface in the production tubing, another feature of the present invention is the addition of its "plunger lift" system that operates inside the production tubing string for the invention's liquid injector to tubing operations just above the bottom tubing fluid operated gas lift valve or optional "venturi tube", in both oil and gas recovery wells with open wellbore applications.

The plunger lift system, which is industry available together with a plunger stop, is set to operate just above the bottom gas lift valve and/or venturi tube. Its "plunger catcher" is set to operate on the vertical tubing surface wellhead. The plunger lift addition facilitates the lift of all type liquid loads through the production tubing string completely to surface, by maintaining the critical liquid to gas interface to prevent the upward flowing lift gas from breaking through the liquid column being lifted. Without this plunger addition, higher pressure injected lift gas could easily break through particularly lower hydrostatic head pressure liquid columns being lifted in the production tubing string and thus lose its needed effective gas lift to the surface. Thus the traveling plunger works as a solid traveling piston like plunger below the liquid column being lifted, to maintain the needed gas/liquid interface and its related efficient liquid lift all the way to the surface, and is disclosed as a highly practical and valuable addition for the invention's ongoing required efficient liquid lifts to surface. (See FIG. 13).

When excessive high volumes of liquids are injected into the production tubing string from the downhole liquid injector, that surpass the plunger's ability to make trips up and down the tubing, then one or more venturi tube jets can be installed on the tubing in order to jet flow lift these high volumes of liquids to the surface by acting as jet lift boosters as the liquid loads pass one of more lift gas injecting gas lift valves up the tubing string.

In natural gas formations, when required, the present invention can also optionally utilize injected selected gases to promote enhanced gas recovery, such as available gas cycling, and/or recycling into the producing gas formation to maintain gas formation pressure above its dew point pressure. And when available, surface injection of a dry gas into a selected part of the gas formation will vaporize condensate and increase its dew point pressure as needed.

Additionally, the optional injection of carbon dioxide or propane, (propane being preferred) and/or other selected gases or fluids into near wellbore and further into formation condensate blocked areas of the gas formation, is disclosed to be used with the invention's gas recovery systems in order to efficiently vaporize any nearby wellbore or within the gas formation gas permeability blocking condensate, thereby increasing gas production flow, when considered necessary. When the present invention's selected gas injection process is applied, a packer, bridge plug, sliding sleeve, and gas lift dummy valves are used similar to the inventions other miscible gas injection scenarios of FIGS. 9 and 11, while the downhole liquid injector remains in the well with a check valve above it to prevent the gas injection from entering it.

Even though in gas formations, condensate once formed as a pure condensate liquid, will readily flow into the gas well's lower pressure wellbore where the present invention's liquid injector will inject it separately into the production tubing, allowing the formation's natural gas to flow freely of liquid burden up the wellbore annulus recovering both condensate and gas at maximum flow rates. In gas well's, the wellbore annulus by the open gas formation is maintained free of liquids, which are pressure injected through the liquid injector valve's larger orifice at high differential volumes from below into the separate tubing string conduit, always leaving the tubing to casing wellbore free for open gas flow into the surface line. Thus the wellbore pressure can be controlled and measured by its standard wellhead surface pressure control valve with a standard surface pressure gauge, to provide the particular wellbore recovery pressure desired from the gas formation for best possible gas flow recovery. The wellhead surface control valve with it pressure gauge can be utilized in most of the illustrated applications of the present invention, at one time or another.

Accordingly, as described above, depending on the liquid or gaseous hydrocarbon recovery application, the present invention can contact a much larger volume area of reservoir hydrocarbons, for increased liquid or gaseous in place recovery, with maximum increased daily oil or gas production. Thus notably total existing in place crude oil, or natural gas and liquid hydrocarbon recovery can be gained from crude oil or natural gas reservoirs, as existing prior art has been completely unable to do.

Hence the present invention discloses novel systems and methods to recover primary secondary and/or unrecoverable total in place oil, as well as primary, secondary gas; or water, oil and/or condensate blocked gas; to recover total in place oil and natural gas in reservoirs where applicable worldwide, notably increasing total in place recovery from and lengthening US and world oil and gas reservoir oil and gas recovery numerous decades.

These and further objects, features and advantages of this invention, will become apparent from the following detailed description, wherein reference is made to the figures in the accompanying drawings.

BRIEF DESCRIPTION OF THE DRAWINGS

FIG. 8 also illustrates an extendable tubular casing expanded wellbore as applied for a second highly significant application of the present invention for gas flow recovery from natural gas formations. Reference is made to the "SUMMARY OF THE INVENTION". In this application the incoming liquid level shown at top perforations, would be substantially lower in the casing wellbore CS annulus A, with the formation LH now a natural gas formation, open flowing its gas production from its open perforations up the casing CS wellbore annulus A out the wellhead valve PR to surface gas sales line. This natural gas formation is flowing its gas production dry up the casing wellbore CS annulus at its maximum flow rate, free of all liquid gradients, while any incoming condensates, oils and/or waters from the open gas formation are being recovered at liquid level LL from downhole up though the Liquid Injector DLD (with or without an extended float as needed), into the separate production string conduct. The present invention's one or more gas lift valves GLV, and its optional venturi jet VJ, above the bottom gas lift valve shown, and/or its plunger lift (not shown) above the bottom gas lift valve GLV are used to efficiently lift the incoming liquids in the tubing to surface. The addition of plunger lift with the gas lift system, is the present invention's option to maintain the needed valuable interface as a traveling piston between lift gas and the liquid column being lifted; without it gas could blow though the liquid, and it is highly effective for lower to average pressure and liquid volume wells, while the present invention's venturi jet works more efficiently for higher pressure & liquid volume wells. The present invention's water drive pressure WDP is maintaining gas formation pressure optimally above its in place gases' critical dew point pressure, maintaining its gas as gaseous, thereby preventing condensate from condensing out of the formation's gas, which causes condensate to problematically form. Preventing condensate from forming in the formation solves the gas production industry's serious problem of "condensate blockage" to gas production flow; thereby obtaining a maximum gas flow production rate, and total in place natural gas recovery. In the few natural gas formations with in place crude oil, the oil is maintained above its optimum bubble point pressure, as a highly mobile fluid during the entire oil recovery procedure, while gas recovery is flowed up the well's wellbore annulus. In a gas formation with detrimental water influx, the invention's water drive pressure WDP is not applied, while its Liquid Injector DLD downhole in the wellbore injects these waters by pressure differential into the production tubing string, removing them to surface, allowing total in place natural gas to flow dry completely free of this water burden (within the flow rate limitations of the Liquid Injector), for maximum in place gas and any liquid hydrocarbon recovery.

FIG. 13 systems is shown in 8, without plunger lift and its gas lift further up hole for required back pressure when needed on the DLD tool's pilot valve to open. Optional venturi tube is most always left out.

Figure 13:
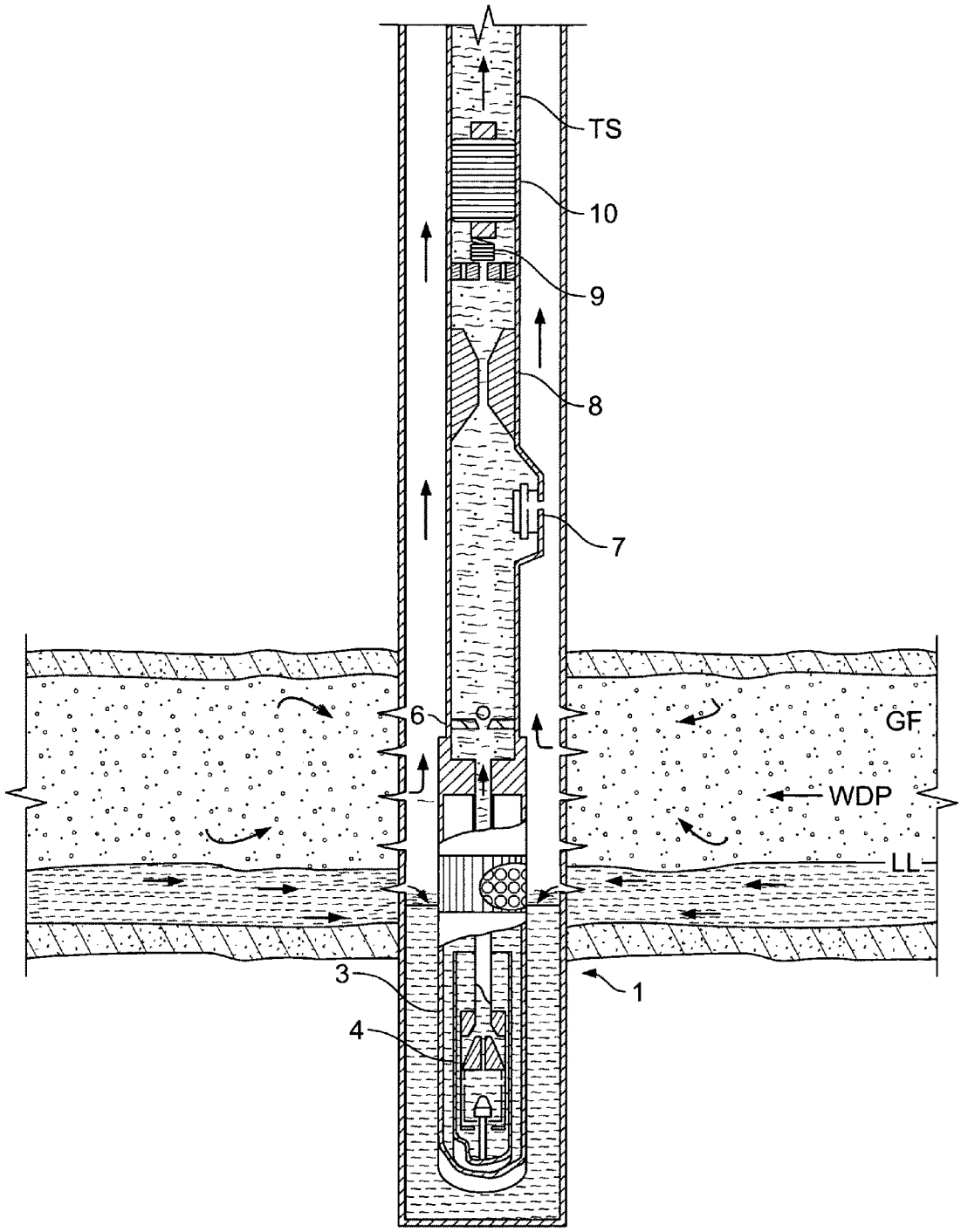
FIG. 13 illustrates schematically the present inventions Deliquifying system for natural gas wells where burdening liquids (water oil and/or condensate) are being immediately produced or removed downhole through the liquid displacer tool into the tubing string with gas lift 7 and plunger lift 9 to surface, while natural gas production from its natural gas zone GF is now flowed dry unburdened by incoming liquids up the tubing to casing wellbore annuals for sales at surface.

The same FIG. 13 also illustrates schematically the present inventions oil recovery system for oil wells with a sizeable upper gas zone GF where original solution gas saturated oil is being produced above its bubble point with optimum casing back pressure being held at the wells wellhead valve, while upper formation gas zone gas is being maintained for gas pressure drive in the gas zone GF.

In both crude oil wells or natural gas wells liquids are being injected through the liquid injector's 3 open float 4, through its open double vale, through its discharge tube, (through rarely used optional check valve 6,) passing on up the tubing string TS passing the first tubing fluid operated gas lift valve 7, (through rarely used optional venture tube 8,) on through the multi orifices of plunger lift stop with spring 9, passing on by the plunger lift 10. When these liquids arrive at a predetermined liquid level in the production tubing string, their liquid pressure opens the bottom gas lift valve 7. The opening gas lift valve 7 introduces wellbore gas of a higher pressure than the liquid level pressure into the production tubing string TS and flows upward to drive the plunger lift 10 with the liquid load above it on up the tubing string with additional gas lift valve injected gas lift boast as needed up hole, driving said liquid load on to surface, where it's discharged for removal, or the case of liquid hydrocarbons for valuable sales. As in all preceding figures related to well depth a series of gas lift valves are located up the tubing string in order to give needed gas lift boast to the rising plunger lift. Optional check valve 6 and venturi tube 8 are in most cases left out due to their orifice restriction to liquid flow. The purpose of the plunger lift is to maintain the gas flow to liquid column interface on the gas lift drive upwards; otherwise gas lift valve injected gas could possibly brake through the liquid column on the lengthy trip up the production tubing string, and lose its effective gas lift. However in high liquid volume wells when the plunger lift doesn't have time to fall back down the tubing string, it is completely left out, and the most feasible type of (casing or tubing operated) high liquid volume gas lift valves are utilized. Here when needed, the venturi tube 8 can be employed to help create a vacuum draw to upward fluid flow and to better distribute a mixture of gas below the liquid column being driven out to surface.

Figure 14:
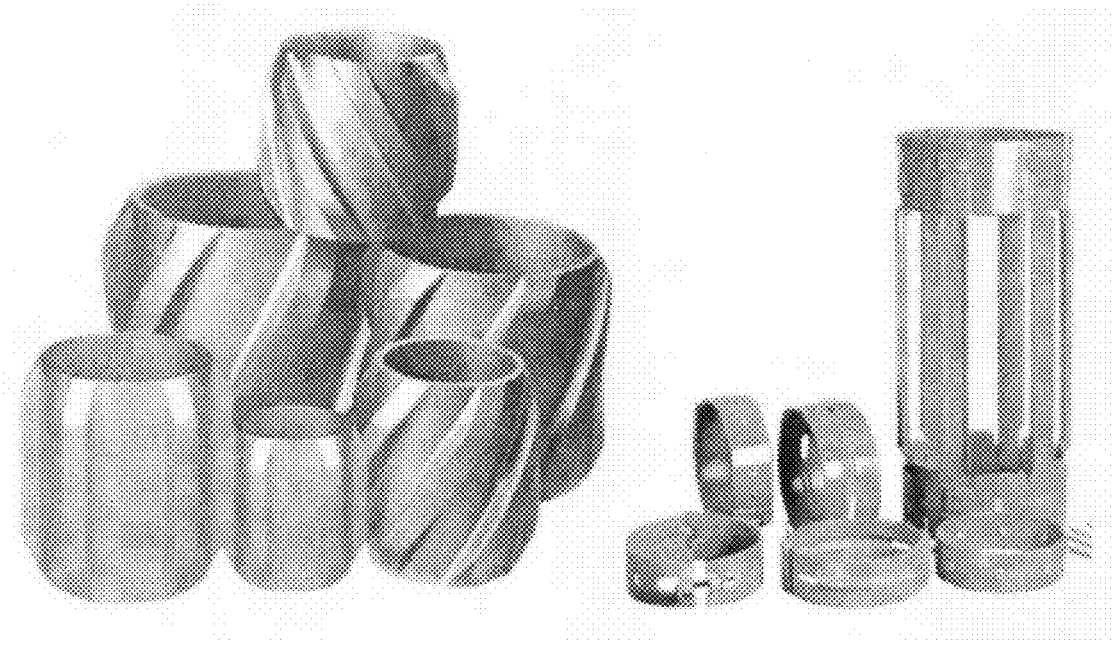

FIG. 14 illustrates typical oil industry centralizers that would be installed on the downhole liquid injector and its screen as collars and slide over's between sand screen and on special sections of the lower DLD tool.

Figure 15:
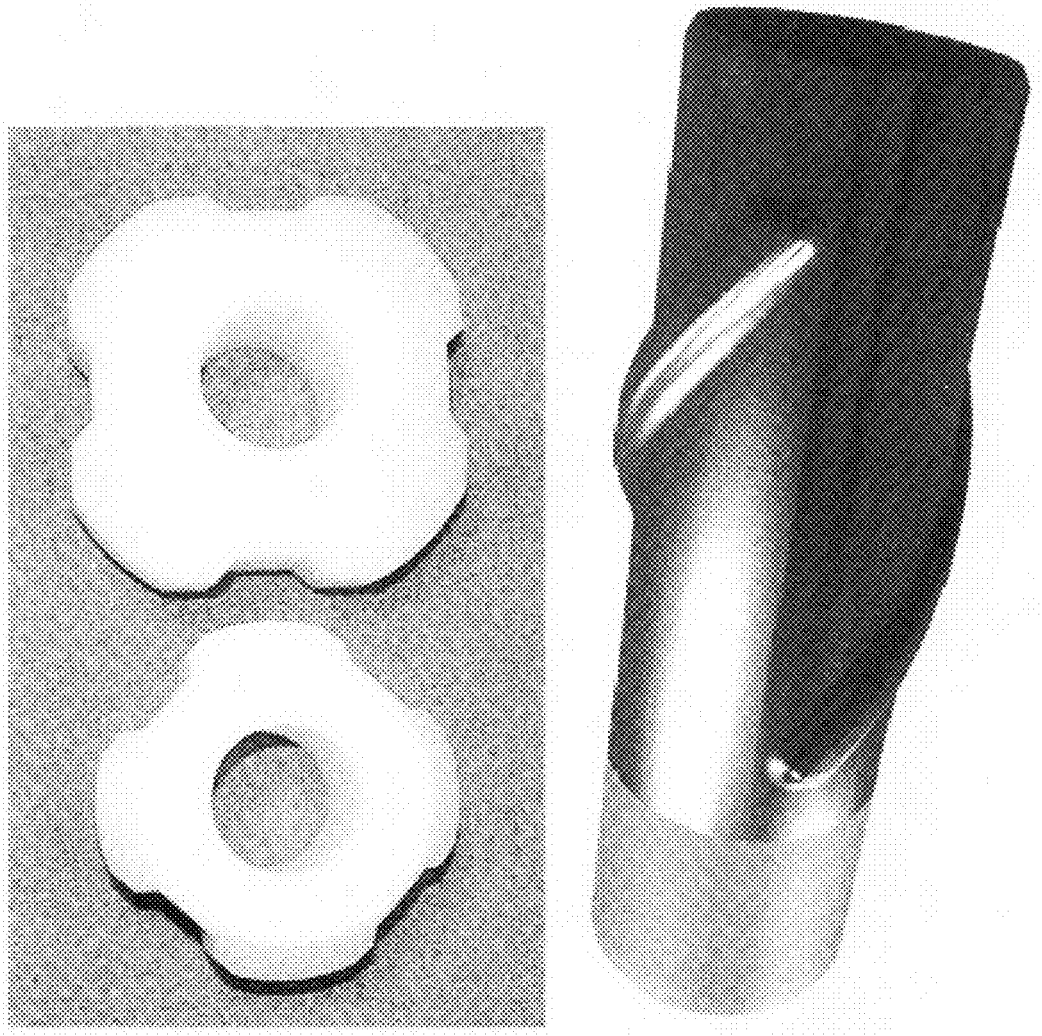

FIG. 15 illustrates other versions of oil industry centralizers that could also be used as described in the specification of the present invention.

Figure 16:
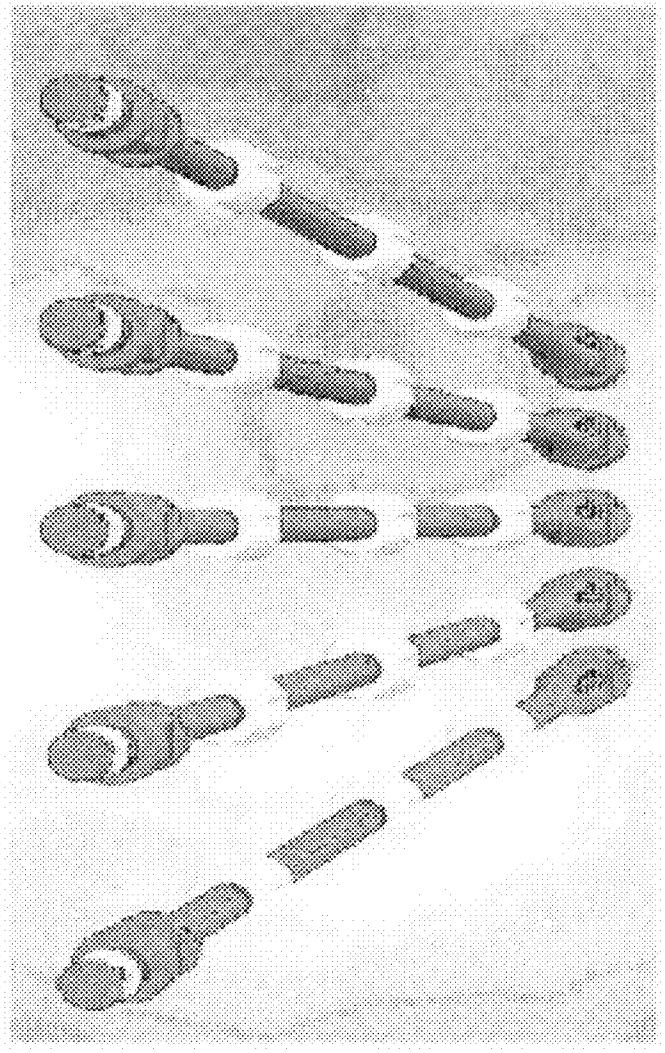

FIG. 16 illustrates a picture of "rod guides" demonstrating how slip over or clamp on centralizers would be used on the downhole liquid displacers sand screen and the lower body tool.

DETAILED DESCRIPTION OF PREFERRED EMBODIMENTS

Figure 1:
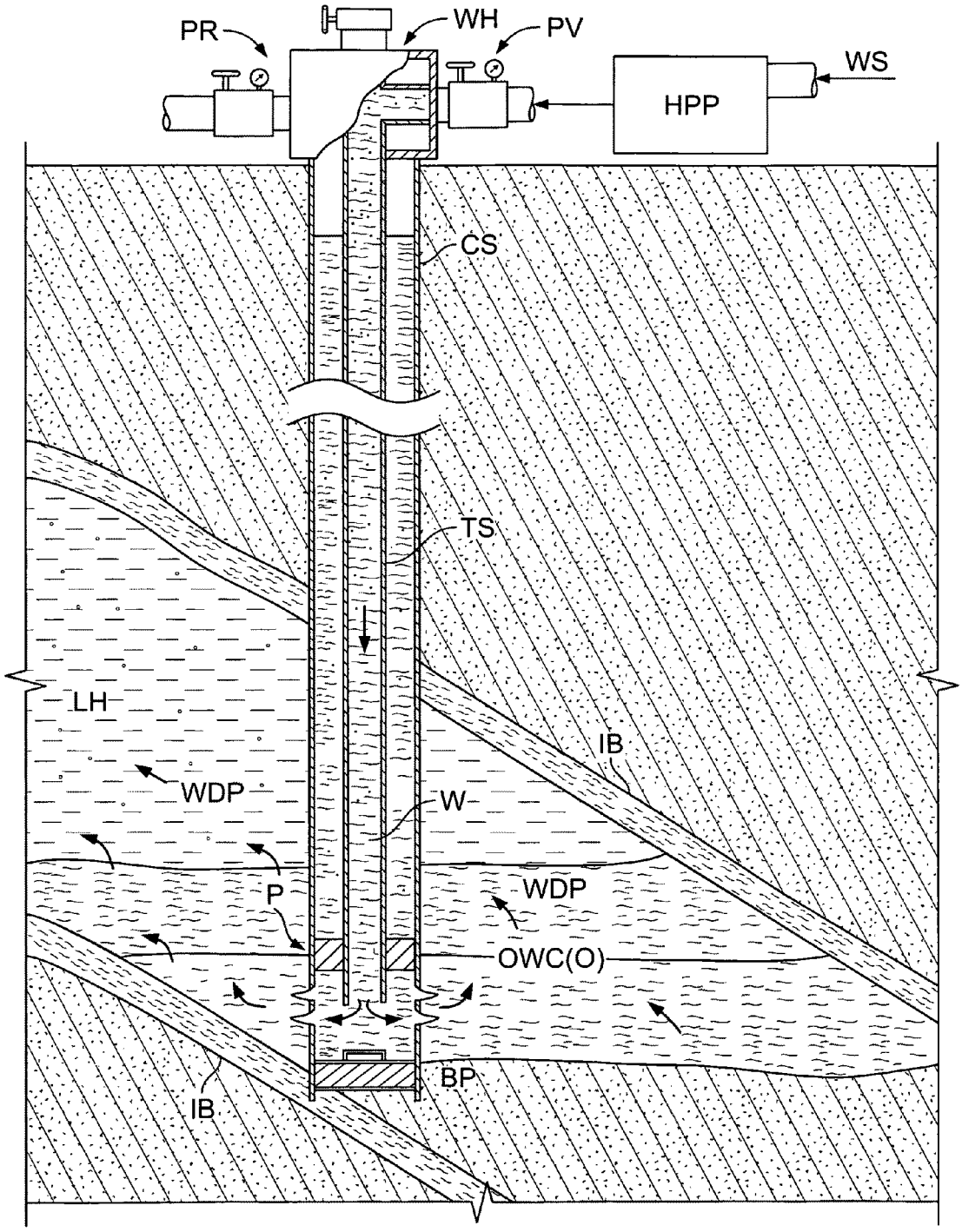
FIG. 1 illustrates a principal features of the present invention, which is one or more water injection well(s) injecting water into a lower or down structure section of a crude oil formation, where the injected water drive force gradually moving up formation increases and maintains pressure on in place oil (and any overhead gas) significantly above its original in place, and/or increased bubble point pressure, optionally created by this invention's miscible gas injection procedure through wells up structure, and optionally for maintaining optimum water drive pressure on that oil during this prior miscible gas injection procedure. The present invention's down structure water injection procedure is also applied on natural gas formations, to increase pressure up structure on in place natural gas significantly above its dew point pressure to reach a maximum gas flow production rate and to positively eliminate "condensate blockage", for total in place natural gas and any in place liquid hydrocarbon recovery into the present invention's recovery wells where liquids are produced through the Liquid Injector into a separate tubing conduct and gas is flowed dry up the wellbore annulus.
Figure 2:
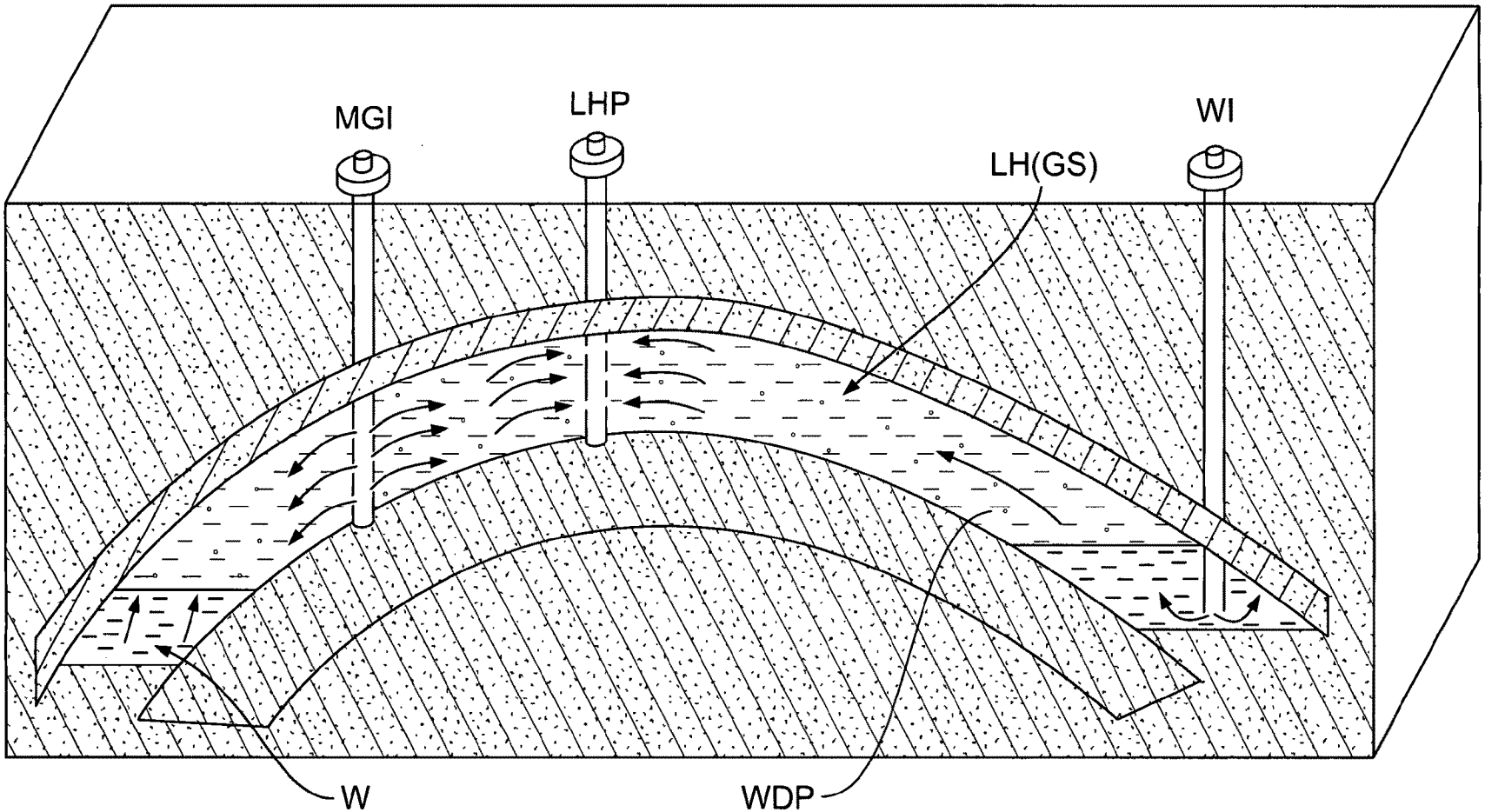
FIG. 2 The present invention is applicable in most all types of crude oil gravities and reservoirs and is meant to be applied in an entire oil reservoir, although sections can be also chosen. Shown is a simplified pictorial view of a cross-section of a gradual dome type oil formation's in place crude oil being pressured up structure above its bubble point pressure by the present invention's one or more down structure water injection wells' WI, water injection procedures, as seen in FIG. 1. This same in place crude oil has been optimally saturated with solution gas by the present invention's up structure miscible gas injection wells' MGI earlier miscible gas injection procedures, in order to flow this newly highly mobile solution gas saturated crude oil back into these same MGI injection wells when converted to the complex's recovery wells LHP in that oil reservoir for total in place oil recovery. The invention's water injection wells WI are permanent during the entire oil recovery procedure, while all its miscible gas injection wells MGI in the field after completing their gas injection processes, are converted to oil recovery wells LHP, for the invention's recovery of total in place crude oil

FIG. 1 illustrates the present inventions' optional water injection well injecting pre-selected volumes of water drive pressure down structure in an oil formation from a high pressure surface pump to below the oil-water contact to create and maintain an upward moving water drive pressure force in the oil formation for compressing up structure oil to a higher pressure by oil displacement within the liquid hydrocarbon formation, for improved and accelerated oil and gas production and recovery where feasible. The present invention also does make use of surface injected water drive pressure to compress natural gas in natural gas formations for compressing in place gas for both accelerated gas production and recovery, and for eliminating condensate blockage by raising gas formation pressure over dew point when needed and feasible.

The present invention can also employ standard steam flood and/or standard fire flood methods down structure in very special crude oil reservoir conditions.

Figure 3:
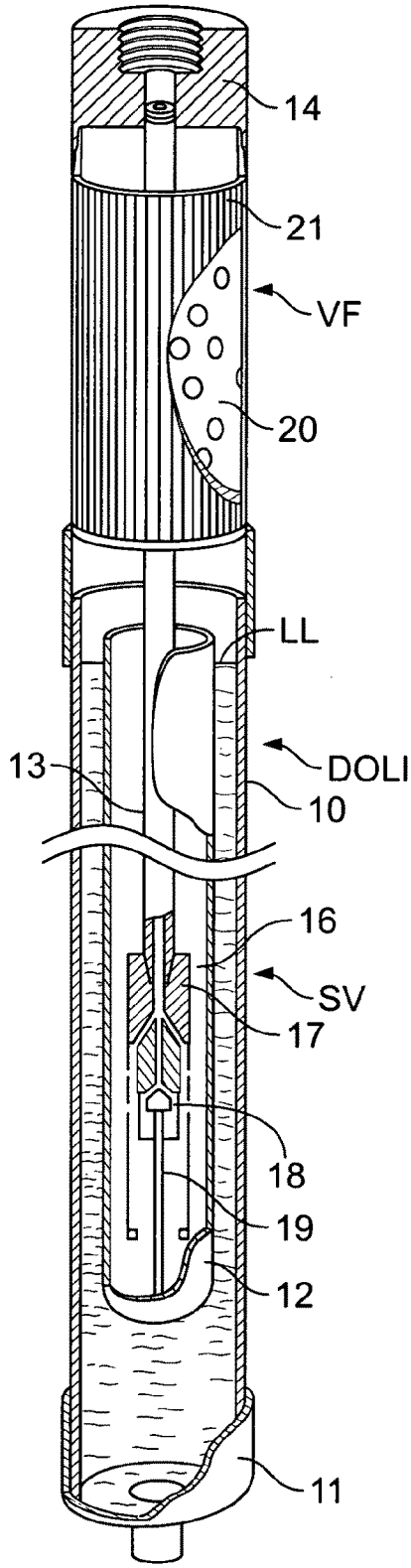
FIG. 3 illustrates a cross-section view of the present invention's downhole Liquid Injector's DLD principal operating tool features. Starting with its head's connection onto the bottom of the production tubing string, then its liquid inlet screen VF, and with a cut away illustrating its opened at top and closed at bottom cylindrical float-operated main 17 & pilot 18 valves, double valve system, that opens and closes as this float fills with incoming wellbore liquids, and submerges, discharging these liquids by wellbore to tubing pressure differential, then rising and closing by its empty float's buoyancy, as shown, until it becomes liquid filled again to submerge and open to continually repeat its liquid injection process into the production tubing.

FIG. 3 is a cross sectional view of the present invention's improved larger 5 in O.D., 5.5 in O.D. 6 in O.D. 6.5 in O.D. and 7 in O.D to 7.5 in O.D. (and even a great deal larger OD. as needed, as now allowed by the present invention's exceptionally larger expandable liner with screens boreholes,) dimension Downhole Liquid Displacer Tools {Labeled DLD or DLD in the figure drawings} which receive all incoming open formation liquids through their individual sand screens 21 (now twice filtered, once through the wellbores expandable liner screens, and once through their own) and down into their open at their top and closed at their bottom cylinder floats 12, which are floating within the lower DLD tools surrounding permanent liquid fill, (as shown with liquid level LL). Its improved enlarged O.D. float 12 inside the significantly larger O.D. DLD tool is now made possible and workable by the present invention's highly beneficial larger O.D. vertical wellbore.

Thus the present invention's larger float can now provide the extra net weight required to submerge for the opening of its traveling pilot tip to traveling valve port 18 and thus opening its traveling main valves tip to its fixed port 17 connected to its larger discharge tube 13 at exceptionally higher bottom hole pressures (as found in original high pressure oil or gas reservoirs and/or newly miscible gas injected oil reservoirs), in order to flow the now larger volumes of ongoing pure liquid inflow directly through the DOLI's screen and on into its this same open float, and though its open valve and into its inner flow tube on into the production tubing string, for now considerably higher increased volume liquid inflow from the open hydrocarbon formation; as now obtained by the present inventions enormously enlarged volume exposure to in place liquid hydrocarbons, by its super enlarged size boreholes.

Thus, once liquid filled the float loses its buoyancy, and submerges opening its double valves smaller pilot valve and then its larger main port valve, to pressure differential inject or displace by gas pressure drive these liquids into the leaser pressure production tubing string, where they are lifted by artificial lift on to surface. Upon full displacement of its liquids, the float becomes buoyant and rises up, thus closing it valves entry into the production tubing string, until it's once again is filled with more formation liquids, which causes its re-submerging and opening again.

Figure 4:
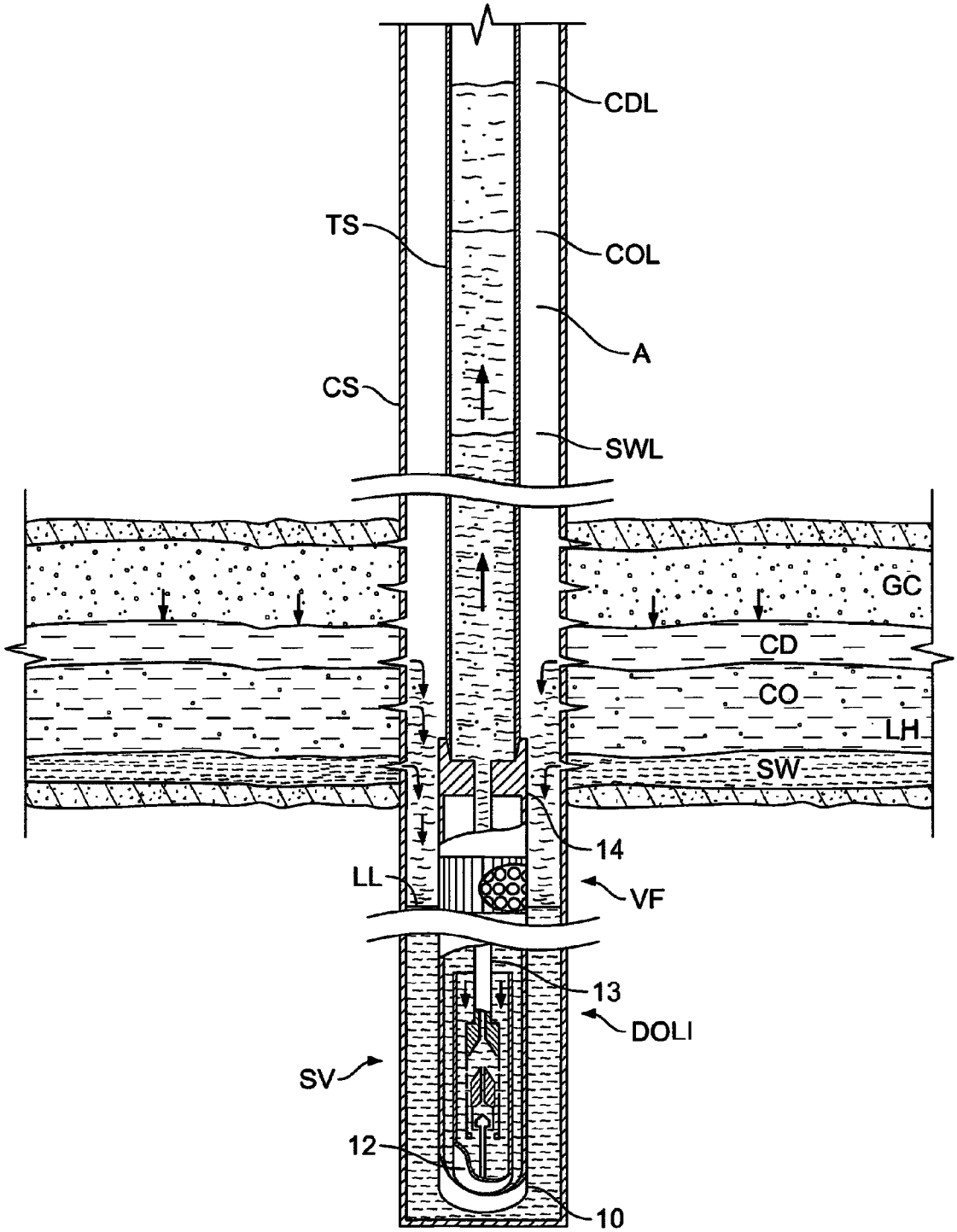
FIG. 4 illustrates an example of how various natural gas or liquid hydrocarbon formation liquids, condensate CD, crude oil CO, and salt water SW, flow downward in the wellbore to fill and open the present invention's, Liquid Injector's float, where they are injected by wellbore to production tubing pressure differential toward the surface in that production tubing string. Relative liquid levels, condensate level CDL, crude oil level COL, and salt water level SWL, that a given operating bottom hole wellbore pressure would lift each liquid through the Liquid Injector's float according to its static gradient, are shown for illustration of the Liquid Injector's static liquid lifting abilities. When needed, the invention's artificial lift methods are applied to lift these liquids to surface.
Figure 4A:
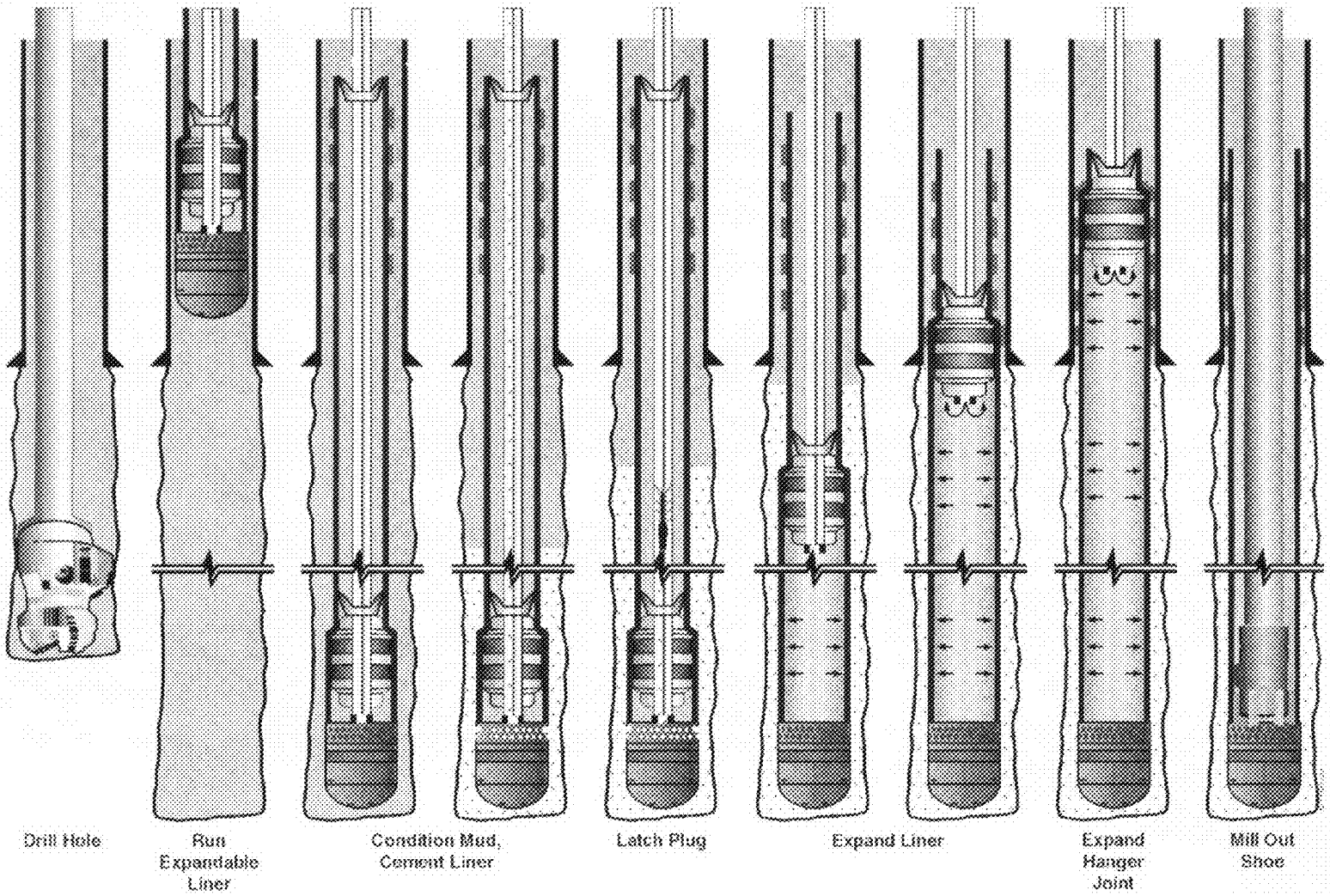
FIG. 4A. Illustrates the present inventions application or running procedure for one of its expandable liners or casing applications, for increased outside diameter (O.D.) size of its wellbores for increased volumetric exposure to formation crude oil and/or natural gas for increased recovery, and for increased size of its downhole liquid displacer DLD tool for needed higher formation liquid volume flow, and higher formation pressure operations. Used for decreasing the loss of diameter each time a new casing string or liner is set, a cold working process is employed whereby the casing or liner can be expanded up to 20% in diameter after being run downhole. For this purpose, an expansion tool that exceeds the inner diameter of the pipe by the required amount of expansion is forced through the pipe. This will be done either hydraulically, by applying mud pressure, or mechanically, by pulling a cone shaped—tapered expansion tool. The expansion needs to be reliable, when expanding several below the surface. This can be from 30 ft-6,000 ft in length. A more instructive field Rig location running procedure for one of these expandable liner installation steps is described under "DETAILED DESCRIPTION OF PREFERRED EMBODIMENTS".

FIG. 4A illustrates the running procedure for its expandable liner in one type application.

1. Rig up casing handling equipment. All equipment should be dressed with low penetrating dies and slips.

2. Pick up the launcher assembly and land in rotary slips. Make up liner and anchor hanger. Fills each joint with clean mud.

3. Rig down casing handling equipment and rig up handling equipment for running inner-string.

4. Make up the inner-string and run inside the liner to the top of the expansion assembly.

5. Fill every five stands of drill pipe with clean mud as it is run in the hole.

6. Tag the top of the expansion assembly with inner-string and make-up.

7/Run in hole to base casing shoe and record pick-up and slack-off weight.

8. Break circulation if required.

9. Pick up 3 ft, condition mud and pump cement. Pump dart and land. Ensure cone is on expansion face while pumping cement and circulating.

10. Initiate expansion and expand first stand length of drill pipe. Bleed off pressure and rack back stand.

11. Continue expanding liner until reaching anchor hanger. Expand first two elastomers of anchor hanger and reduce pump pressure.

12. Exit top of liner with expansion assembly.

13. Reverse or direct circulate any excess cement.

14. Test liner and pull out of hole with expansion assembly.

15. Run in hole and drill out float equipment.

Running Procedure for Expandable Liner

1. Underream hole to required dimensions.
2. Pick up the launcher assembly and make up liner and anchor hanger.
3. Make up the inner-string and run inside the liner to the top of the expansion assembly.
4. Tag the top of the expansion assembly with inner-string and make-up.
5. Run liner to bottom.
6. Condition mud and pump cement.
7. Pump dart and land. Ensure cone is on expansion face while pumping cement and circulating.
8. Initiate expansion and expand first stand length of drill-pipe.
9. Continue expanding liner until reaching anchor hanger.
10. Expand anchor hanger and test liner.
11. Run in hole and drill out float equipment.

FIG. 4 illustrates the markedly higher levels in the production tubing string of three different pure type liquids found in a hydrocarbon formation with larger or standard O.D. DLD tool in an expanded or standard wellbore. Such liquids being lifted by the higher bottomhole pressures BHP now found. in the present inventions unique applications through its now improved larger O.D. Downhole Liquid Displacer tool. An exceptionally high pressure example of 3,000-psi BHP would lift condensate (CD) 9,400 ft; 30 deg. crude oil (CO) 7,900 ft; and saltwater (SW) 6,000 ft. When found in crude oil and/or gas reservoirs higher pressures will lift these liquids to, or closer to the wells surface, while maintaining such higher wellbore to formation pressures are both essential and indispensable to the present invention's success in recovering oil reservoirs. While significant pressure downhole wellbore levels are common in most flowing natural gas reservoirs, where the DLD tool displaces all incoming burdening to gas flow liquids into the production tubing string for production or removal, like condensate, crude oil and/or wasters.

Figure 5:
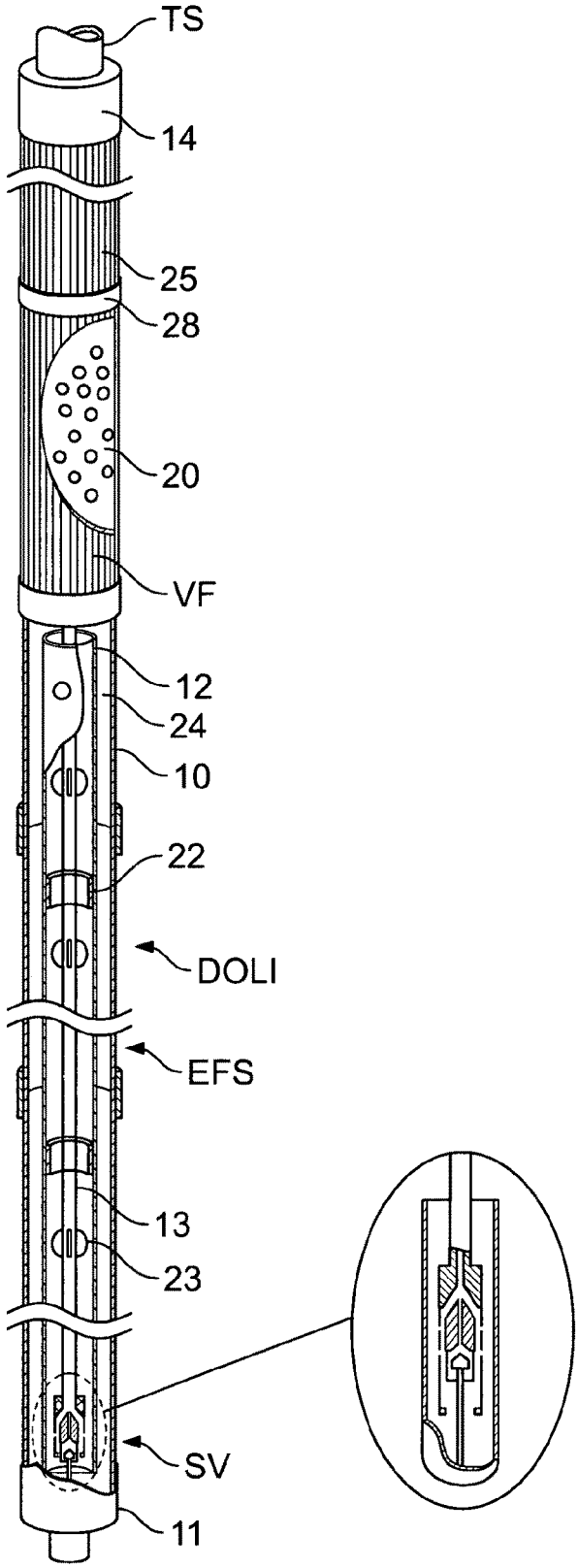
FIG. 5 illustrates the present invention's Liquid Injector's alternative extended length float EFS, required when excessively high formation to wellbore pressure, and minimum tubing pressure, create a high pressure differential so high such that the net single length liquid-filed float weight (as seen in FIG. 3) cannot open the float's pilot valve. The present invention's extended length float adds the weight as needed; and to further lower high pressure differentials, it can be counterbalanced by liquid load in the tubing above it (as seen in FIG. 4). These needed improvements to the tool will open the Injector's pilot valve at all variable exceptionally high operating bottom hole wellbore pressures created by the present invention's optional high water drive, gas cap and miscible gas injection pressures.

FIG. 5 illustrates the present invention's larger O.D. extended float system operating within its now larger O.D. Downhole Liquid Displacer Tool (DOLI) in which now added float lengths provide the added weight needed to pull open the pilot vale open, thus opening the larger main valve when higher bottom pressures are found in the tools new higher bottom hole pressure applications. The extended float system EFS in the DLD is illustrated by two breaks in the figure which shows a much larger O.D. 24-ft float within a now large-diameter 5½-in. OD up to 7.5 in O.D system, (and even above) with two to three specially connected float sections that would extend the total float and flow tube to about 72 ft. One additional float extension which equals 48" of float handles higher pressure conditions found, but higher bottom-hole well pressure can use three or even more extensions of float.

Figure 6:
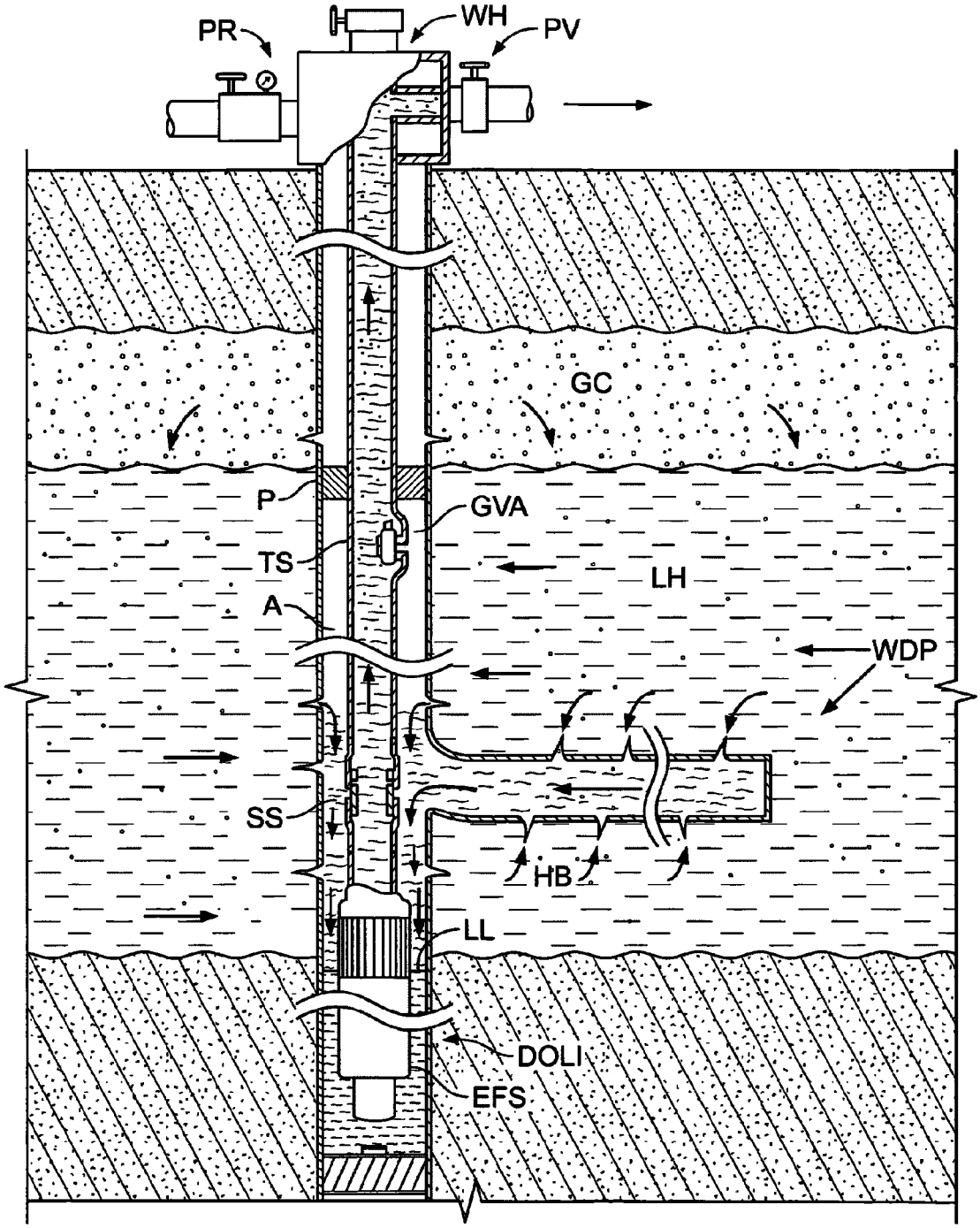
FIG. 6 illustrates schematically an extendable tubular casing expanded wellbore as applied in original primary in place solution gas-saturated crude oil; or tertiary, secondary or primary crude oil optimally solution gas saturated after the present invention's miscible gas injection procedure. Both scenarios are flowing this solution gas saturated oil into perforated horizontal and/or vertical wellbores, where the wellbore or wellbores are maintained at an optimum lower pressure, still above the oil's highest existing bubble point pressure, controlled by the present invention's gas vent assembly GVA, but high enough to flow this incoming crude oil through the Liquid Injector's opened float and valve to surface. When needed, artificial lift can be used. Optimum pressure on this crude oil above its highest existing bubble point pressure in its formation is specially created and maintained by the inventions down structure water drive pressure WDP, which also creates additional pressure on the gas cap GC. Optional additional gas-cap GC gas injected gas drive pressure can be used in the present invention, when feasible and needed.

FIG. 6 illustrates the application of present inventions notably enlarged vertical and horizontal O.D. boreholes for now appreciably increased volumetric exposure to the crude oil formation, in order to establish an exceptionally higher volume of oil production and recovery. This higher volume of oil refers to not only daily volume production but also recovery from a higher volumetric area of oil reservoir due to the enlarged longer horizontal borehole, and an equally enlarged DLD tool to produce its daily production The well shown is producing new original in place and/or returned by the present invention's miscible gas injection procedure solution gas saturated crude oil all the way to the surface by high pressure differential through the present invention's (notably improved by its exceptional enlargement alteration) Downhole Liquid Displacer tool DLD system. Thus recovering total in place reservoir oil to the very last oil left in the reservoir by means of this present inventions novel larger O.D. wellbore design. The DLD shown with two "breaks" means it could have an extended float system EFS as shown in FIG. 5. The DLD displaces all incoming formation solution gas saturated oil and all liquids into the tubing, where this oil is produced all the way to surface by the pressure differential, (as shown in FIG. 4). The driving force that on the whole moves the reservoir oil to the DLD system and to the surface is reservoir gas pressure, or gas cap drive, or where not fully present by the addition of optional surface injected water drive pressure. Otherwise for maximum production and recovery, both in cooperation, when feasible.

Oil recovery contact from the vertical and horizontal wellbores is now enhanced by the present invention's enlarged expandable liner boreholes section with its highly valuable expandable sand screen addition for double screening out sand from the DLD tool as any sand at all can plug the tools very small pilot valve. Thus double screening is by far preferred. That is oil is s screened now once though the expandable screen liner and then though the DOLI's screen.

The present invention's extensively lengthy larger O.D. horizontal borehole emphasized by the "break" symbols (up to 8,000 ft has been recorded) has been drilled from a side-track from the vertical casing with expandable bits, then cased with an expandable drilling liner, completed with sections of perforated liner, with elastomeric end seals and expandable mesh sand screens over defined productive zones, provides for super enlarged volumetric exposure for the recovery of solution gas saturated highly mobile oil into the vertical wellbore though the DOIL, and on to surface.

Such enlarged volumetric exposure to high volumes of solution gas saturated fluidly crude oil will absolutely flood the vertical wellbore with extremely high volumes incoming oil production which the present inventions enlarged DLD can now handle by delivering this high volume of crude oil all the way to surface.

FIG. 6 can be an original oil reservoir or a newly miscible gas injected one. The now higher volumes of oil can not be calculated but are estimated to be very easily over 15,000 to 20,000 barrels of solution gas saturated crude oil per day, of which the now improved larger size DLD tools can in deed handle! Thus the present invention has many valuable and innovative features, to provide its end result of total in place oil recovery.

Figure 7:
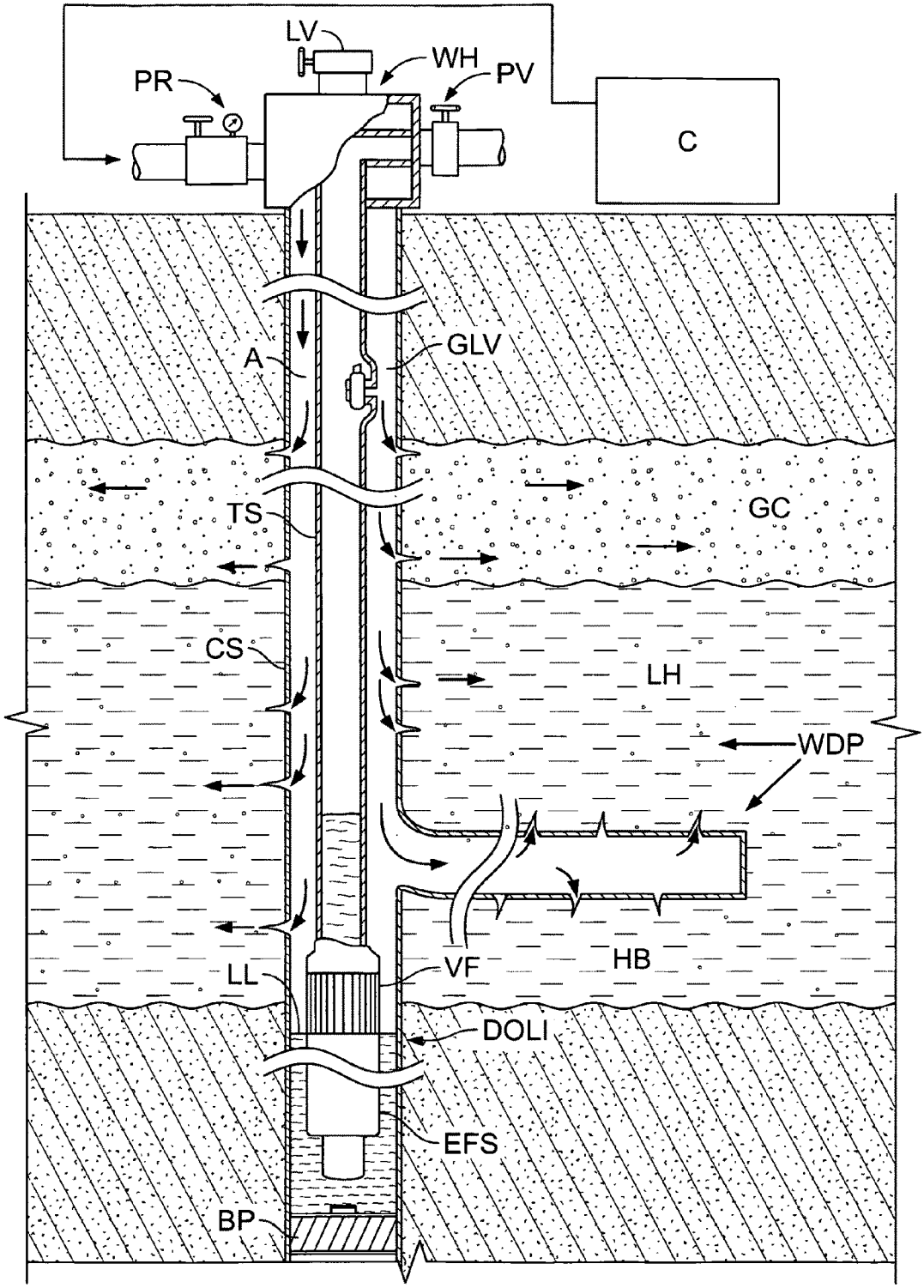
FIG. 7 illustrates the present invention's an extendable tubular casing expanded wellbore as applied for a miscible gas injection procedure down the well's vertical wellbore annulus into perforated vertical and/or horizontal wellbores directly into the oil formation LH, where this miscible gas contacts in place oil at an optimum injection pressure, reaching an "equilibrium" state and entering into solution with that oil. The present invention's miscible gas injection procedure continues until optimum solution gas saturation is obtained in a predetermined oil formation area. The Liquid Injector DLD with its extended float system EFS as needed, seen on the bottom of the tubing, along with one or more gas lift valves above it, will be used for oil recovery, after the miscible gas injection procedure is completed, when the well is converted to this same present invention's solution gas saturated crude recovery method. The liquid injector automatically closes to high gas injection pressure after its float empties of liquids during the gas injection procedure.

FIG. 7 illustrates the application of present invention's enlarged O.D. vertical and O.D. horizontal boreholes by expandable liners and sand screens for increased volumetric exposure to the crude oil formation, for an exceptionally higher volume oil recovery by the present invention's miscible gas injection procedure down the well's vertical wellbore annulus into perforated vertical and/or horizontal wellbores directly into the oil formation LH, where this miscible gas contacts in place oil at an optimum injection pressure, reaching an "equilibrium" state and entering into solution with that oil. The present invention's miscible gas injection procedure continues until optimum solution gas saturation is obtained in a predetermined oil formation area. The larger OD. Liquid Injector DOLI (with its optional only extended float system EFS) is seen on the bottom of the tubing, along with one or more gas lift valves above it, will be used for oil recovery, after the miscible gas injection procedure is completed, when the well is converted to this same present invention's solution gas saturated crude recovery method. The liquid injector automatically closes to high gas injection pressure after its float empties of liquids during the gas injection procedure.

Figure 8:
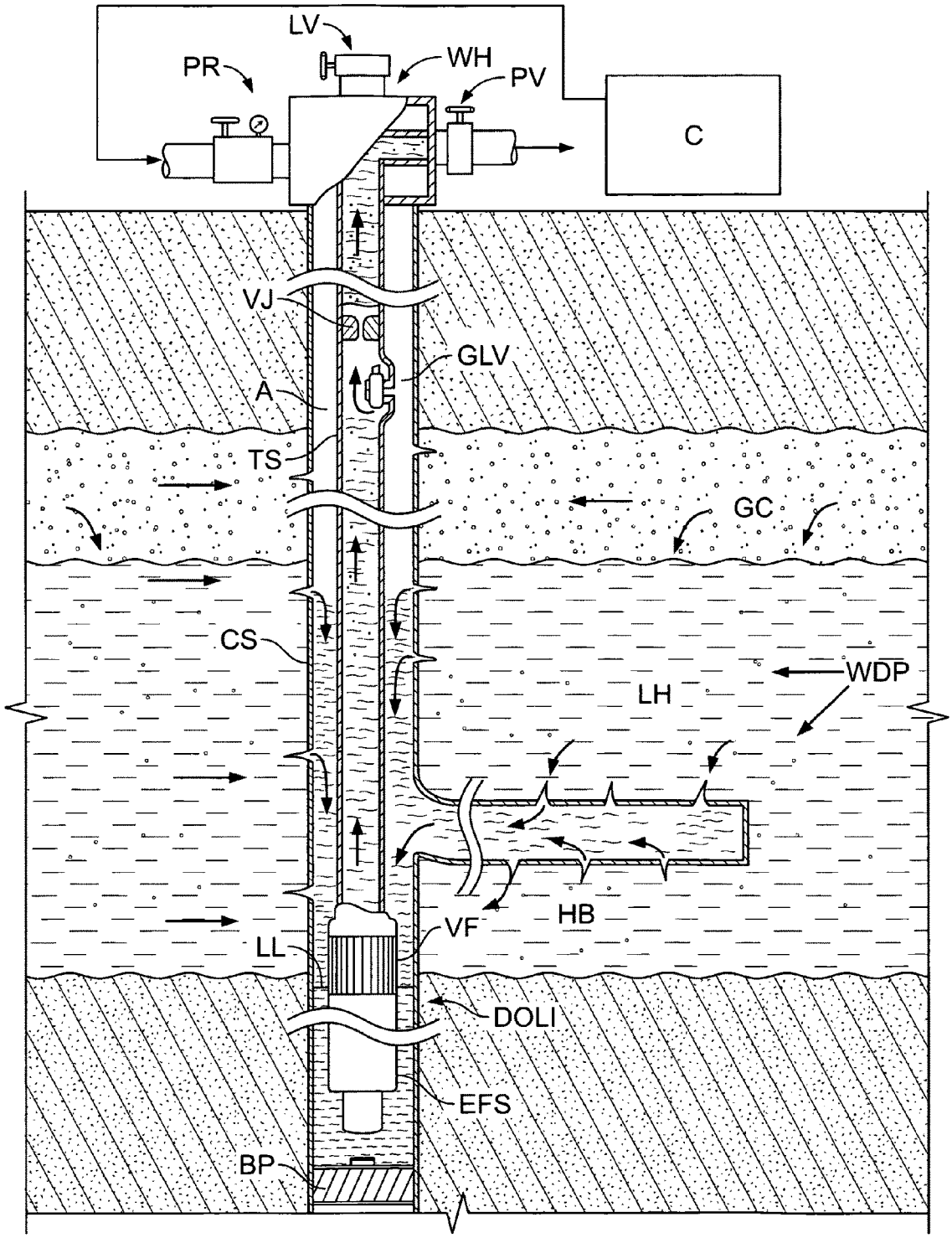
FIG. 8 illustrates two important oil & gas recovery applications an extendable tubular casing expanded wellbore as applied for the present invention. This description is for oil recovery, and the description below (also FIG. 8) is for natural gas recovery. Here the oil recovery application shows the invention's miscible gas injection procedure of FIG. 7 converted to its solution gas saturated crude oil recovery procedure through the Liquid Injector into the production tubing. An optimum pressure drop, still above the oil's last highest existing bubble point pressure is created and controlled in the wellbore by the surface wellhead casing (pressure regulator) valve & pressure gauge PR, for drawing oil into the wellbore and directly into the Liquid Injector, where a significant second pressure drop (available to liquid only) is created when the Liquid Injector's float & valve opens to the production tubing, where pressure differential between wellbore and tubing, depending on depth, either pressure injects this recovering oil to surface, or above the first of one or more gas lift valves for complete gas lift to surface; an optional venturi jet shown above each gas lift valve enhances this gas lift, helping maintain its gas liquid interface to surface, as a type of stage lift method. The present invention's water drive pressure WDP is continually maintaining the oil within its formation LH, optimally above the oil's highest existing bubble point pressure, maintaining an optimum pressure drive mechanism, and the oil highly mobile during the entire solution gas saturated oil recovery procedure, for total in place crude oil recovery. The present invention's oil recovery system shown here with its optional water drive pressure WDP is also applied on original primary solution gas saturated oil in its primary reservoir, (with or without its miscible gas injection procedure as needed), to recover this oil above its bubble point pressure. Both these oil recovery procedures of the present invention are described in the "Detailed Description" while the present invention's relevant gas recovery application is described below.

FIG. 8 illustrates the application of the present inventions enlarged vertical and horizontal O.D. boreholes by applying its new expandable liner and sand screens in appreciably enlarged O.D drilled boreholes for now greatly increased volumetric exposure to the natural gas formation in the entire reservoir. Such enlarged exposure to total in place natural gas obtains a higher volume of natural gas flow of daily gas production and ultimate recovery from an exceptionally higher Volumetric area of actual natural gas reservoir from a considerably increased reservoir area of gaseous or liquid hydrocarbon recovery.

i.e. where numerous gas wells operated before now one well with the expandable liner with screen enlarged O.D. vertical and optionally horizontal boreholes could handle. This is claimed for increased natural gas and liquid hydrocarbon recovery by the present invention.

For even further accelerated gas production and recovery the present invention can also employ optional surface injected water drive pressure in a natural gas reservoir when feasible, by injecting water into a selected section of the down structure natural gas formation. This novel and unique procedure of the present invention is used on gas formations that do not have water invasion in order to initiate an upward moving water drive pressure force, for compressing that gas formation's total in place gas and liquid hydrocarbons, increasing and maintaining pressure up structure on in place gas considerably above its dew point pressure, where this water drive force significantly accelerates gas flow recovery during the present invention's novel separate gas flow and liquid removal procedures. However the water injection has to be adequately far away down structure in order to not break through the larger O.D. vertical and horizontal boreholes.

Thus when optionally applied in FIG. 8, or FIG. 13, the present invention's water drive pressure WDP is maintaining gas formation pressure optimally above its in place gases' critical dew point pressure, maintaining its gas as gaseous, thereby preventing condensate from condensing out of the formation's gas, which causes condensate to problematically form. Preventing condensate from forming in the formation solves the gas production industry's serious problem of "condensate blockage" to gas production flow, thereby obtaining a maximum gas flow production rate, and total in place natural gas recovery. However with the present inventions DLD tool displacing all high volumes of incoming liquids into the production tubing string for removal to surface, therefore also liquid condensate will be easily produced from the gas formation into the DLD tool for removal into the production tubing string to be gas lifted and plunger lifted to the wells surface.

In cases of the present invention's application in FIGS. 8, 10, 12, & 13, when very high volumes of liquid surpass the plunger's ability to travel up the tubing string and back down, then straight gas lift can be used.

The present invention's surface injected water drive pressure into the gas formation GF down structure, as can be seen in FIG. 1 is used principally for crude oil reservoirs, but can be used optionally for natural gas formations. i.e. the present invention can work in natural gas formations without it, but it can resolve particular gas production problems, or be taken advantage of for both improved natural gas flow production and recovery and liquid hydrocarbon (crude oil & condensate) production and recovery.

The water drive addition also works especial good in gas reservoirs that have a large percentage of in place crude oil, which is not uncommon in natural gas formations. This water drive pressure WDP force in a natural gas formation with considerable in place oil will in actuality apply pressure on and compresses both the oil and gas up formation to accelerate oil and gas flow recovery out of the producing wells as shown in FIG. 8 most others. As seen in FIG. 8 or FIG. 13, gas is free flowing up the wellbore annulus wide open, free of liquid interference, while all incoming liquid hydrocarbons (oil & condensate) are being injected into the tubing TS lifted by fluid operated gas lift valve injected gas and plunger combination, or gas lift alone (gas lift valves with mandrels can be in stage lift) in very high volume liquid hydrocarbon wells to be recovered at surface, thus producing liquid and free gas flow through separate conduits, for total in place recovery of both hydrocarbons.

In natural gas formations with detrimental water influx, the present invention's water drive pressure WDP is not applied, while its Liquid displacer DLD downhole in the wellbore displaces these invading problem waters by pressure differential into the production tubing string, removing them to surface, allowing in place natural gas production and recovery to flow natural gas wide open completely dry totally free of this water burden, thereby increasing gas production and ultimate recovery. Numerous gas wells are "logged in" or lost, and closed in because of water invasion, thus the present invention provides solution for many of these gas wells.

In addition, the optional injection of dry natural gas or carbon dioxide or propane, (propane being preferred) and/or other selected gases or fluids can be injected from the surface down the tubing string TS and through the sliding sleeve SS opened into the condensate causing gas permeability blocked areas of the gas formation, is disclosed to be used with the gas recovery system shown in FIG. 8 (plunger, venturi tube, and gas lift valve would be removed from tubing string, while a packer would be set just above the sliding sleeve SS and a bridge plug below, both which are not shown, in order to seal off the area to be injected into) to efficiently vaporize any nearby wellbore or within the formation gas permeability blocking condensate, thereby increasing gas production flow, when required or preferred.

However with the present inventions DLD tool displacing all high volumes of incoming liquids into the production tubing string for removal to surface, then also condensate liquids would be drawn out of the gas formation into the DLD tool for removal into the production tubing string to be gas lifted and plunger lifted to the wells surface. Thus condensate blockage is not seen to be a problem, but there remain these options of using gas injections into the gas formation and/or water drive, as described above.

Figure 9:
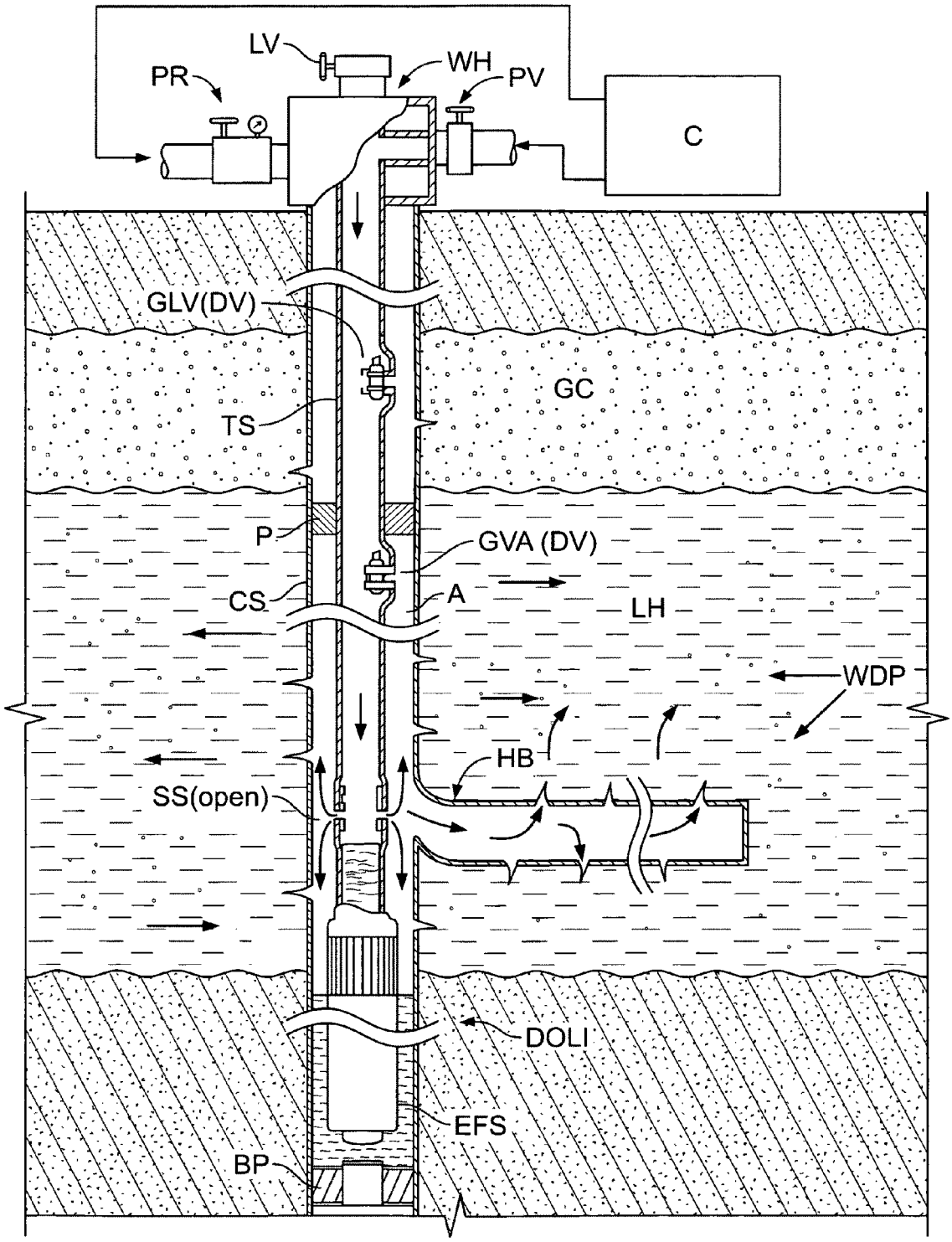
FIG. 9 illustrates an extendable tubular casing expanded wellbore as applied for as a highly significant feature of the present invention, where natural gas compatible with its own crude oil is drawn directly off the oil formation's LH associated upper gas cap GC above packer P, by the surface compressor to re-inject this same gas down the tubing and out the open sliding sleeve directly back into its own oil formation, to reenter into solution with its compatible oil, thereby adding optimum solution gas saturation for its enhanced and total in place recovery. The arrow pointing into the casing annulus and pressure regulator valve PR from surface compressor C indicates natural gas being drawn off the gas cap GC through the pressure regulator valve PR by the compressor C. When sufficient gas cap gas is not present for use as a compatible miscible gas, an outside source of miscible gas can be used, while optionally miscible or non-miscible gas can be injected down the upper wellbore annulus into the opened gas cap for increased overhead gas pressure drive. The invention's optional water drive pressure WDP is usually not required during the miscible gas injection procedure; however it can be used to benefit the miscible gas injection procedure when needed. Preinstalled gas lift and gas vent valves are equipped with dummy valves during this gas injection process, then armed with real gas lift valves by wire line, before the present invention's conversion to its oil recovery process.

FIG. 9 illustrates the present invention drawing oil formation natural gas compatible with own crude oil direct from the wells crude oil formation's LH own gas cap GC and re-injecting this gas by means of the surface compressor CC into the wells wellhead valve PV back down the tubing string TS and out the tubing's open sliding sleeve SS and direct into the vertical and horizontal wellbores which are now expandable liner and screen O.D.'s boreholes. Into the larger O.D. openly exposed vertical and horizontal oil formation areas. The formations own gas cap injected gas readily enterers into solution with it own compatible crude oil at its required injection pressure. The wells re-injected gas cap gas passes a dummy gas lift valve mandrel and the DLD at the bottom of the tubing provide a closed valve to injected gas. FIG. 9 also shows this gas injection procedure from its surface compressor down the tubing string with an isolation packer set below the gas cap to separate the gas cap GC in the wellbore from its lower oil formation LH. The larger improved DLD is pre-installed on the tubing string in the larger O,D, expanded liner vertical wellbore. This DLD tool remains closed due to only gas entry into it during the gas injection process.

Figure 10:
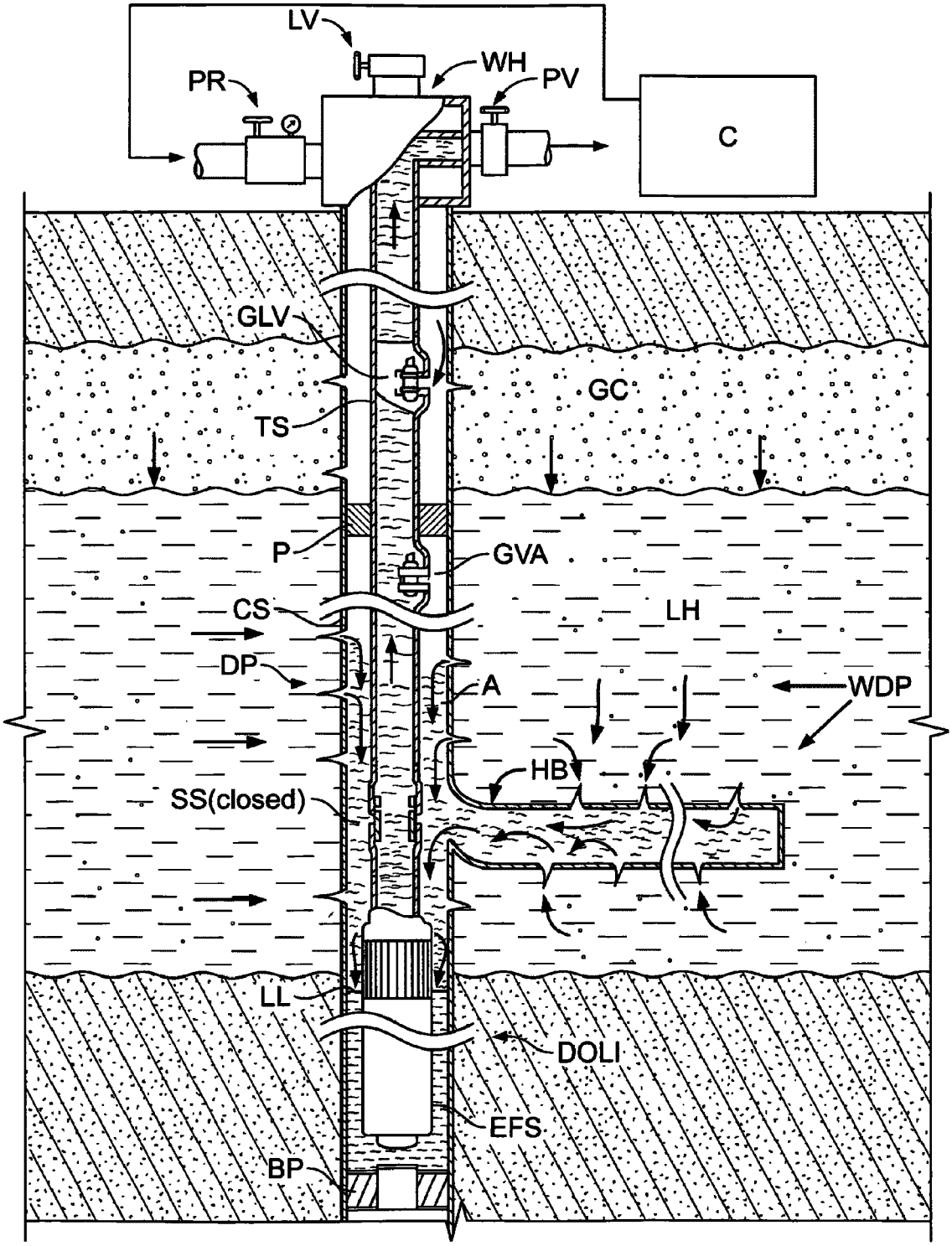
FIG. 10 illustrates an extendable tubular casing expanded wellbore as applied for the present invention's miscible gas injection phase of FIG. 9, after it has reached its maximum solution gas saturation level in a given formation area, and been converted to its solution gas saturated crude oil recovery, by surface compressor C halting the gas injection procedure, and maintaining equal gas pressure between tubing and wellbore annuluses to change the dummy gas lift GLV (DV) and gas vent assembly valves GVA (DV) for real valves. Then closing the sliding sleeve by wire line, so that the gas vent assembly releases & lowers wellbore gas pressure to its designed optimum, allows solution gas saturated crude oil to flow in as a liquid into the lower pressure wellbore and directly into the Liquid Injector DLD at liquid level LL, where the Liquid Injector injects it up the tubing to be gas lifted to surface. Recovering crude is maintained above bubble point pressure by both the gas vent assembly and down structure water drive pressure, while gas cap pressure is also maintained by this water drive pressure WDP and the surface casing valve PR and optionally the compressor C. This casing annulus valve PR is used for upper or total wellbore pressure control as needed in all scenarios of the present invention.

FIG. 10 illustrates FIG. 9 now converted to the present invention's solution gas saturated crude oil recovery procedure, recovering now highly mobile solution gas saturated and now non-viscous crude oil from a very large area of the same oil reservoir area contacted by the miscible gas injection procedure of FIG. 9. The Miscible gas injection procedure of FIG. 9 converted the now vast reservoir area of oil to highly valuable recoverable oil, thus FIG. 10 teaches how to from top to bottom completely and systematically recover this solution gas re-energized oil from this same vast oil reservoir area above its bubble point pressure for its total in place recovery. Also FIG. 10 could be a new original solution gas saturated oil reservoir, where new solution gas saturated crude oil is now being produced and recovered form a now very enormous section of that reservoir using both gas cap and optional water drive WDP for total original in place oil recovery.

In FIG. 10 the crude oil is flowed as a liquid above its bubble point pressure though the larger O.D. DLD tool and into the tubing string, where solution gas does not break out of the oil until its inside the production tubing string and out of the reservoir formation rock. Wellbore pressure control is fully maintained at the wellhead surface (tubing to casing) casing control valve PR, thus recovering total original or miscible gas injected oil above it very critical bubble point pressure form the now large volume area exposed by the much larger O.D vertical and horizontal wellbores which are now cased with expandable liners and screens.

In FIG. 10 once oil is displaced by the large O.D. DLD tool into the production tubing string pressure differential lifts that oil to a pre-determined or programmed level (see FIG. 4)) then this oil is lifted on to surface and into the wells surface separator by the present invention's plunger lift which operates by higher pressure wellbore lift gas injected by fluid operated gas lift vale or valves on the tubing string below the plunger lift to start and continue its travel upward below the oil. The plunger lift acts as a piston to keep the gas (to the now highly light fluid gas saturated oil) oil liquid "inter face' or the gas lift drive could possibly break though the now very light oil in which gas is breaking out of solution in as it moves upward in the tubing string, thus providing an efficient oil lift up the production tubing string and on to the wells surface separator and storage tanks. Once the plunger lodges in the well head plunger catcher, the In FIG. 10 correct method application of the present invention results in the well now literally flooding in enormously large volumes of solution gas saturated highly fluid oil at maximum flow rates by means of the present inventions larger wellbores offered by its expandable technology, which has located now larger diameter wellbores with in-place sand screens (for filtering out formation sand form the large DLD tool) deep into the oil reservoir opening thousands of feet of now much larger O.D. horizontal borehole.

And the present invention's larger O.D. expandable liner and screen wellbores have enabled the extension of large diameter liners (or casing) in the vertical wellbore to total well depth to allow the location of new, larger diameter Downhole Liquid Displacers DLD tools of 6.5-in. ODs up to 7.5-in O.D or larger within the now considerably larger OD liners even in exceptional deep wells, which with present conventional casing technology absolutely can not do with larger casings to total well depth, in most any depth well, say nothing of much deeper wells. Thus all these combined novel matter improvements work together for the present invention's astonishing end result, which total in place oil and gas recovery.

Figure 11:
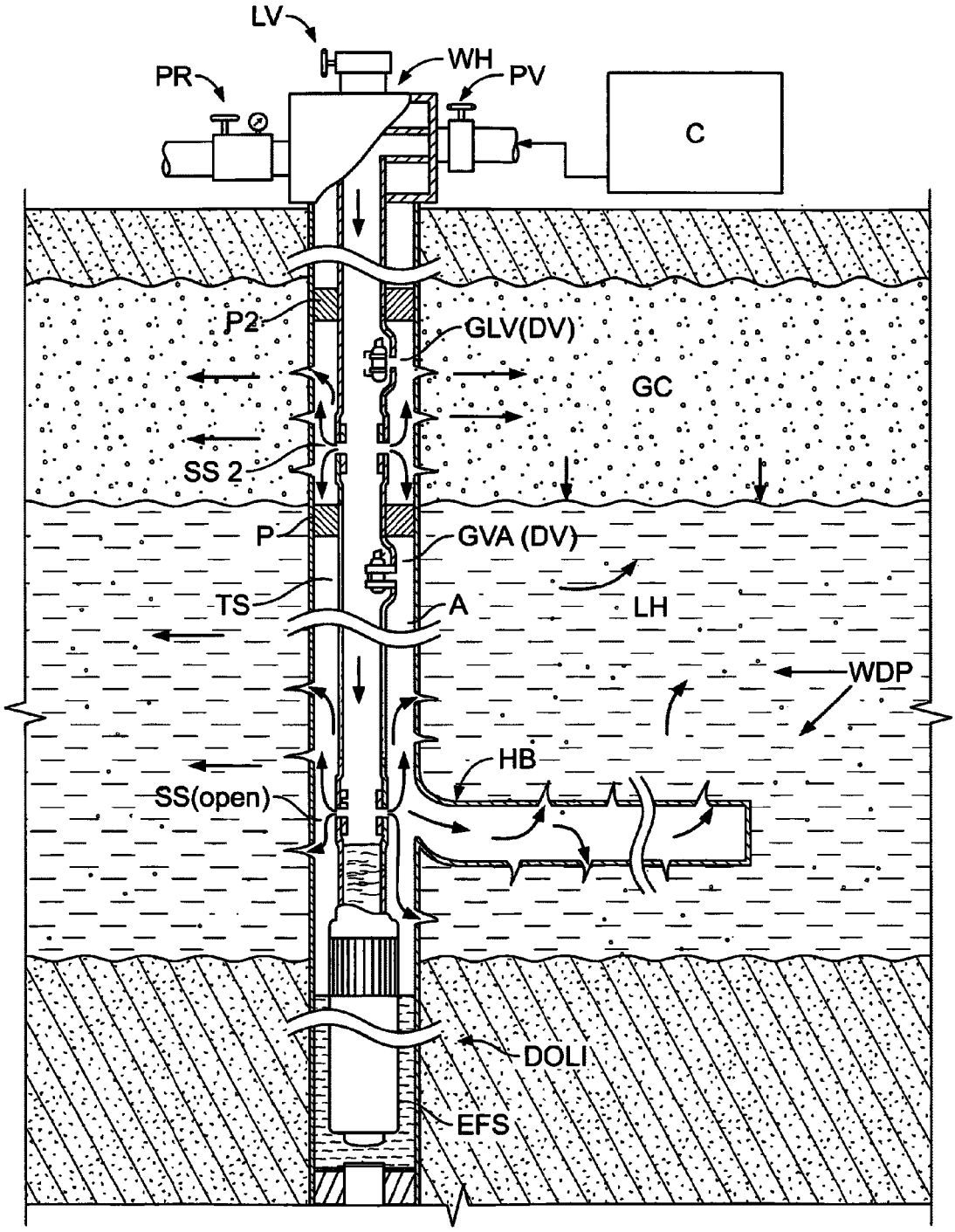
FIGS. 11 and 12 illustrating the present inventions extendable tubular casing expanded wellbore as applied for the miscible gas injection procedure of FIG. 9, when an outside source of miscible gas is being used, and the oil recovery procedure of FIG. 10, with the exception that the perforated crude oil formation LH and its associated open gas cap GC are located below upper open hydrocarbon formations, which requires that injection and production zones be isolated by a second packer above the gas cap, and a second sliding sleeve to open and close the gas cap to the tubing for these procedures. Thus this perforated oil formation below other open formations can be miscible gas injected and recovered independently from other formations in the same well, without expensive plugging etc.

FIG. 11 illustrates the present invention's extremely large O.D. size vertical and horizontal boreholes. These extremely large size boreholes are required to drill the present invention's large size side tracks off the large O.D. horizontal wellbore for maximum borehole penetration into the hydrocarbon reservoir for maximum hydrocarbon recovery from an extended reservoir area. In this Fig these new large diameter boreholes are to be lined (in part in whole) with the present invention's expandable liner and sand screens.

Also illustrated in FIG. 11 for the present invention's miscible gas injection procedure is the tubing string completed with an isolation packer P to isolate the vertical well bore's open oil zone from its open gas cap above. One or more temporary dummy plugged gas lift valves are shown on the tubing TS. The wire line operated sliding sleeve is opened into the entire wellbore complex (the wells opened by expandable liner and screen vertical and horizontal wellbore or wellbores and their deep penetrating expandable liner and screen side tracks are thus shown The DLD tool in shown on the tubing TS whose valve is in its closed position by its float being empty.

FIG. 11 is specially demonstrating how the present invention can be applied to completely open up a huge reservoir area of a rather thick crude oil or natural gas reservoir completed by the present invention's application with exceptionally deep and exceptionally enlarged O.D vertical and horizontal boreholes cased with expandable liner and screens, in order to drill deep side tracks also set with expandable liners and screens.

The FIG. 11 shown is a crude oil reservoir, where the present invention's expandable liner and screened side tracks have been drilled and set from its large O.D size vertical and horizontal expandable liner and screened wellbores. Once completed the final additional large size O.D. vertical and horizontal (expanded liner and screened) wellbores, are then drilled and completed with extremely deep penetrating expanded liner and sand screened side track boreholes or wellbores, which now grant access and entry into an immense and massive body of (old degassed or newly discovered) crude oil by means of its now enormous net work of cased and sand screen wellbores for maximum exposure to this in place crude oil from a now vast oil reservoir body area, in order to most productively apply the present invention's miscible gas injection procedure.

This new wellbore complex of the present invention can now easily cover what numerous conventional wells would have covered, in this mammoth crude oil reservoir area. With this network of wellbores (now screen for sand) the present invention's miscible gas injection procedure can now re-saturate this vast oil reservoir area in place oil with increased solution gas saturation up to its preprogrammed and/or maximum optimal level for its extremely profitable mobile recovery.

Figure 12:
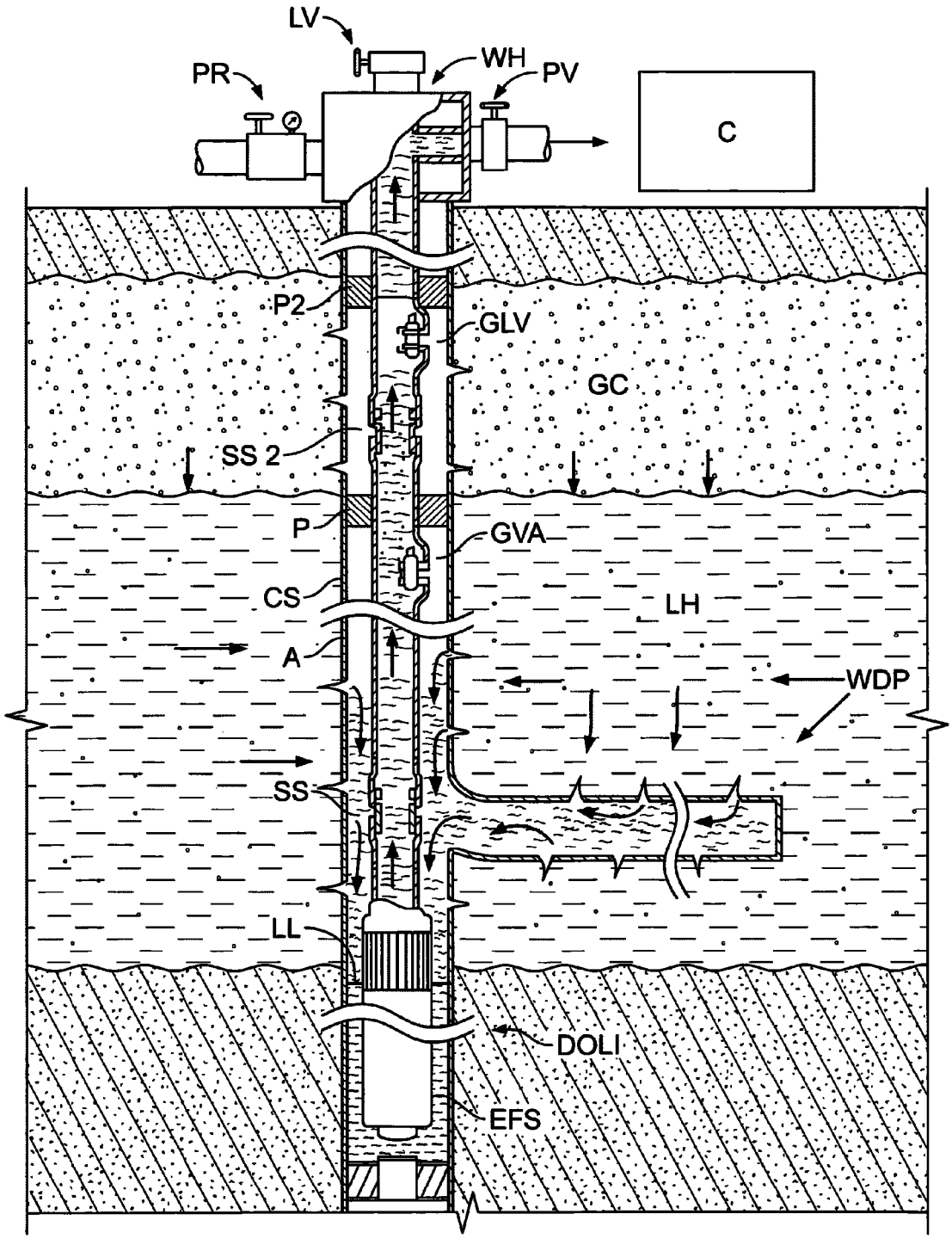

FIG. 12 illustrates FIG. 11 now converted to the present invention's solution gas saturated crude oil recovery procedure, by FIG. 11's dummy gas lift valve or valves being removed and replaced by a real fluid operated gas lift valve or valves, for stage lift, and a plunger lift installed, all by wire line. And packer P being unseated, and the sliding sleeve SLSV being wire line closed to isolate liquid-only production through the DLD into the tubing string, with gas pressure in the wellbore annulus controlled by the wells surface wellhead casing valve PR at the systems optimum back pressure on the oil formation recovering now exceptionally mobile and fluid solution gas saturated and non-viscous crude oil from an extensively large area covered by FIG. 11's net work of large O.D. boreholes covered by expandable liner and sand screens in the same oil reservoir area contacted by the miscible gas injection procedure of FIG. 11. The Miscible gas injection procedure of FIG. 11 converted the now vast reservoir area of oil to highly valuable recoverable oil, thus FIG. 12 demonstrates how to completely recover this solution gas re-energized oil from this same vast oil reservoir area above its bubble point pressure for its total in place recovery.

Also FIG. 12 could be a new original solution gas saturated oil reservoir, where new solution gas saturated crude oil is now being produced and recovered form a now very enormous section of that reservoir using both gas cap and optional water drive WDP for total original in place oil recovery.

Thus 12 (as in FIG. 10) the mobile solution gas saturated crude oil is flowed as a liquid above its highest bubble point pressure though the larger O.D. DLD tool and into the tubing string, where solution gas does not break out of the oil until its inside the production tubing string and out of the reservoir formation rock. Wellbore pressure control is fully maintained at the wellhead surface (tubing to casing) casing control valve PR, thus recovering total original or miscible gas injected oil above it most critical bubble point pressure form the now large volume area exposed by the much larger O.D vertical and horizontal and sidetrack wellbores which are now cased with expandable liners and screens.

In FIG. 12 once the formation's incoming crude oil enters the present invention's large O.D. DLD tool's float and the float submerges opening the DOLI's double valve, this oil is then displaced by wellbore to tubing string pressure differential through this open DLD valve into the production tubing string where this same pressure differential lifts that oil to a pre-programmed level (see FIG. 4)) then this oil is lifted on to surface and into the wells surface separator by the present invention's plunger lift which operates by higher pressure wellbore lift gas injected by the installed by wire line real fluid operated gas lift vale or valves on the tubing string below the plunger lift to start and continue its travel upward below the oil. The plunger lift acts as a piston to keep the gas (to the now highly light fluid gas saturated oil) oil liquid "interface" or the gas lift drive could likely break though the now very light oil in which gas is breaking out of solution in as it moves up ward in the tubing string, thus providing an efficient oil lift up the production tubing string and on to the wells surface separator and storage tanks. Once the plunger lodges in the well head plunger catcher, the oil is moved by the tail gas into the wells surface oil gas separator.

FIG. 13 illustrates schematically the present inventions Deliquifying system for natural gas wells with an expandable liner and optionally sand screed wellbore for maximum natural gas and liquid hydrocarbon production and recovery, where burdening liquids (water oil and/or condensate) are being produced or removed to surface through the liquid displacer tool into the tubing string, while natural gas production from its natural gas zone GF is flowed dry Deliquify and unburdened by incoming liquids up the tubing to casing wellbore annuals for sales at surface.

The same FIG. 13 also illustrates schematically the present inventions oil recovery system for oil wells with a sizeable upper gas zone GF where original solution gas saturated oil is being produced above its bubble point with optimum casing back pressure being held at the wells wellhead valve, while upper formation gas zone gas is being maintained for gas pressure drive in the gas zone GF.

In both crude oil wells or natural gas wells liquids are being injected through the liquid injector's 3 open float 4, through its open double vale, through its discharge tube, (through optional check valve 6,) passing on up the tubing string TS passing the first tubing fluid operated gas lift valve 7, (through optional venture tube 8,) on through the multi orifices of plunger lift stop with spring 9, passing on by the plunger lift 10. When these liquids arrive at a predetermined liquid level in the production tubing string, their liquid pressure opens the bottom gas lift valve 7. The opening gas lift valve 7 introduces wellbore gas of a higher pressure than the liquid level pressure into the production tubing string TS and flows upward to drive the plunger lift 10 with the liquid load above it on up the tubing string with additional gas lift valve injected gas lift boast as needed up hole, driving said liquid load on to surface, where it's discharged for removal, or the case of liquid hydrocarbons for valuable sales. As in all preceding figures related to well depth a series of gas lift valves are located up the tubing string in order to give needed gas lift boast to the rising plunger lift. Optional check valve 6 and venturi tube 8 are in most cases left out due to their orifice restriction to liquid flow. The purpose of the plunger lift is to maintain the gas flow to liquid column interface on the gas lift drive upwards; otherwise gas lift valve injected gas could possibly brake through the liquid column on the lengthy trip up the production tubing string, and lose its effective gas lift. However in high liquid volume wells when the plunger lift doesn't have time to fall back down the tubing string, it is completely left out, and the most feasible type of (casing or tubing operated) high liquid volume gas lift valves are utilized. Here when needed, the venturi tube 8 can be employed to help create a vacuum draw to upward fluid flow and to better distribute a mixture of gas below the liquid column being driven out to surface Application of the present invention according to the foregoing disclosure where practical in numerous primary and secondary crude oil recovery operations worldwide will recover extremely close to the total original, or remaining in place crude oil, (at 90's plus %, bordering on 100%,) which has never been seen by the US & World oil industry and is to the highest degree possible over the US & World oil industry's extremely costly and hard to obtain present highest levels of 40% or less original oil in place.

One of many features of the present inventions is its novel process of markedly expanding wellbore O.D. size exposure to an oil reservoir area to in place oil for total in place oil recovery from this large oil reservoir area, injecting miscible gas into in place crude oil lacking solution gas saturation and then recovering this solution gas saturated in place crude oil at new high accelerated rates above its critical highest bubble point pressure.

Thus the present invention which covers both crude oil and natural gas recovery complex's, has been now disclosed to be an indisputable and practical solution to the US and World's looming oil supply crises.

Hence for this purpose the present invention can be applied Worldwide in old oil and gas reservoirs as well as newly discovered ones wherever effective according to the foregoing disclosure, to notably extend the US and the Worlds' crude oil and natural gas reservoir recovery life times to produce and recover very nearly all the world's total in place crude oil, or natural gas and condensate, has thus been disclosed and described.

The forgoing disclosure and description of the present invention's crude oil and natural gas recovery complexes are thus explanatory thereof. It will be appreciated by those skilled in the art that various changes in the sizes shapes and materials, as well in the details of the illustrated construction and systems, combinations of features, and methods as discussed herein may be made without departing from this invention. Although the invention has been described in brief detail for various embodiments, it should be understood that this explanation is for illustration, and the invention is not limited to these embodiments. Modifications to the system and methods described herein in the inventions various complexes will be apparent to those skilled in the art in view of this disclosure. Such modifications will be made without departing from the invention which is defined by the claims.

The invention claimed is:

1. A method for liquid hydrocarbon recovery from one or more opened liquid hydrocarbon formation(s) through a production tubing string in a vertical wellbore, the method comprising:

providing an enlarged diameter vertical wellbore annulus, using expandable liner procedures, within the opened liquid hydrocarbon formation(s);

providing the production tubing string down the vertical wellbore near or below a selected opened liquid hydrocarbon formation, with an enlarged diameter liquid displacer tool on the bottom of said production tubing string, for preventing gasses at higher level formation pressures from passing into the production tubing string, said enlarged diameter liquid displacer for producing higher level liquid volume inflow;

providing a surface wellhead with a pressure control valve and a pressure gauge for controlling a selected optimum wellbore annulus to a selected opened a liquid hydrocarbon formation liquid hydrocarbon recovery pressure;

producing the opened liquid hydrocarbon formation liquid inflow through the enlarged liquid displacer into the production tubing string completely on to the surface by wellbore annulus to production tubing string pressure differential;

maintaining the selected opened liquid hydrocarbon formation under controlled wellbore annulus to liquid hydrocarbon formation pressures above that of in place crude oil's key bubble point pressure, utilizing the surface wellhead pressure control valve thereof, in which the liquid hydrocarbon formation liquid inflow production is improved by the enlarged diameter vertical wellbore annulus, with the enlarged diameter liquid displacer producing increased liquid level inflows; and utilizing any precisely designed artificial lift to lift liquids from the expanded vertical wellbore annulus when the expanded vertical wellbore annulus to production tubing string pressure differential through the enlarged diameter liquid displacer tool cannot lift incoming liquids completely to the surface.

2. The method as defined in claim 1, wherein using any precisely designed artificial lift, further comprises:

providing one or more gas lift valves strategically spaced up hole on the production tubing string above said enlarged diameter liquid displacer to lift liquids to the surface, said gas lift valves for selectively injecting enlarged diameter vertical wellbore annulus gasses into the production tubing string for lifting columns of incoming liquids through the production tubing string onto the surface;

creating an efficient gas to liquid interface and sweeping action when the bottom gas lift valve opens;

providing a continued type gas lift to gas lift, in level by level of the incoming liquids in order not to lose their gas lift velocity on to the surface;

assisting said enlarged diameter liquid displacer's liquid lift up hole through specifically designed gas lifting of the total enhanced incoming volumes of liquids completely on to the surface.

3. The method as defined in claim 1, wherein the enlarged diameter vertical wellbore is provided with connecting horizontal and/or deviated wellbores into the liquid hydrocarbon formation(s), which selectively are made into a larger outside diameter by expandable liner procedures for an increased exposure area to the in place liquid hydrocarbons for increased volume recovery area of said liquid hydrocarbons, from both the vertical, and any horizontal and/or deviated wellbores, the enlarged diameter liquid displacer tool for higher daily liquid volume flow production at higher operating pressures;

providing in the liquid displacer a larger discharge tube for less liquid flow friction and for adding a larger diameter float opening weight with increased float closing buoyancy, for opening and closing a double shutoff valve's pilot valve in the liquid displacer, at higher maintained high operating liquid hydrocarbon recovery pressure differentials between the enlarged diameter wellbore annulus's and the vertical production tubing string, for increased higher volume and pressure recovery of liquid hydrocarbons; and providing the vertical wellbore and any selected connecting horizontal and/or deviated wellbores with an expandable sand screen for total wellbore filtration of any formation sands entering the enlarged diameter liquid displacer, for sand screened increased exposure area to the in place liquid hydrocarbons, and for-increased sand filtered volume area recovery of liquid hydrocarbons.

4. The method as defined in claim 3, further comprising:

injecting water down structure into the liquid hydrocarbon formation as a means for increasing pressure within the liquid hydrocarbon formation; and compressing the up structure in place liquid hydrocarbons by said injected water drive pressure, whereby creating a selected higher pressure on said in place liquid hydrocarbons for pressurized enhanced recovery of said in place liquid hydrocarbons, thereby obtaining total in place liquid hydrocarbon recovery.

5. A method for natural gas recovery from an opened natural gas formation, by producing the formations natural gas through the tubing to casing wellbore annulus and on to the surface, the method comprising:

providing an enlarged diameter vertical wellbore annulus employing expandable liner procedures in a gas well with one or more opened natural gas formation(s); providing a production tubing string down the enlarged diameter vertical wellbore by or below a chosen opened natural gas formation, with an enlarged diameter liquid displacer on the bottom of the production tubing string, for preventing wellbore gasses from passing into the production tubing string;

producing each chosen opened natural gas formation's liquid hydrocarbons and/or water influx into said production tubing string and onto or toward the surface by wellbore annulus to production tubing string pressure differential;

providing the enlarged diameter vertical wellbore annulus with a surface wellhead with a pressure control valve and a pressure gauge for producing gas flow into a surface gas sales line;

producing formation liquids through liquid displacer on into the production tubing string and to surface, for enhanced recovery of formation hydrocarbon liquids, and removing any detrimental waters while producing natural gas outside of tubing; and using any specially chosen or effectually developed select artificial lift when the enlarged diameter vertical wellbore annulus to production tubing string pressure differential through the enlarged diameter liquid displacer tool cannot lift incoming liquids completely to the surface.

6. The method as defined in claim 5, wherein the enlarged diameter vertical wellbore is selectively provided with connecting horizontal or deviated wellbores, which selectively are made into a larger outside diameter by expandable liner procedures for an maximally increased exposure area to the in place natural gas and any in place liquid hydrocarbons, for increased volume recovery area of said natural gas and any liquid hydrocarbons, and for an enlarged outside and inside diameter liquid displacer tool, the enlarged diameter liquid displacer for higher daily liquid volume production at higher operating pressures;

providing the enlarged liquid displacer with increased float size with increased closing buoyancy, for opening and closing a double shutoff valve's pilot valve inside the float in the enlarged liquid displacer, at higher operating pressures, and with a larger diameter discharge tube for less liquid flow friction in the enlarged liquid displacer, at higher maintained operating pressure differentials between the wellbore annulus and the vertical production tubing string, for increased higher volume and pressure recovery of natural gas and any liquid hydrocarbons;

providing the enlarged vertical wellbore and/or any enlarged connecting horizontal and/or deviated wellbores selectively with an expandable sand screen for enlarged vertical and horizontal and/or deviated wellbores sand screened filtration of any formation sands entering the enlarged liquid displacer, for increased sand screen exposure area to the in place natural gas and any liquid hydrocarbons for sand filtered increased volume area recovery of gaseous and liquid hydrocarbons.

7. The method as defined in claim 5, wherein using any select artificial lift, further comprises:

providing one or more gas lift valves optimally spaced up hole on the production tubing string above said enlarged diameter liquid displacer, said gas lift valves for selectively injecting enlarged diameter vertical wellbore annulus gasses into the production tubing string for lifting columns of incoming liquids level by level through the production tubing string on to the surface;

creating a more efficient gas to liquid lift interface, pressure sweeping action when the bottom gas lift valve opens, providing an in sequence, level by level gas lift method;

improving the gas lift effectiveness of the incoming liquids on to the surface; and improving said enlarged diameter liquid displacer's pressure differential liquid lift up through the production tubing string toward the surface.

8. The method as defined in claim 5, further comprising:

injecting water down structure into said natural gas formation as a means for increasing said in place natural gas and any in place liquid hydrocarbons to a higher optimum recovery pressure;

producing any incoming liquid hydrocarbons through the enlarged diameter liquid displacer tool into the production tubing string and on to the surface by the increased wellbore annulus to production tubing string pressure differential and when not using gas lift with any specially selected or effectually developed artificial lift as needed, and flowing gas production through the tubing to casing wellbore annulus through the surface wellhead pressure control valve and on out into the surface gas sales line, thereby both increasing and accelerating in place natural gas production and recovery, and any in place liquid hydrocarbon production and recovery.

9. The method as defined in claim 5, further comprising;

injecting water down structure into said natural gas formation having natural gas and any in place crude oil, thereby increasing pressure on said natural gas and in place crude oil in order to accelerate the natural gas and any increased in place crude oil flow into the enlarged diameter vertical wellbore;

producing the increased crude oil volumes through the enlarged diameter liquid displacer tool into the production tubing string and on to the surface by wellbore annulus to production tubing string increased gas pressure differential and when not using gas lift with specially selected or developed select artificial lift as needed;

providing the surface wellhead pressure control valve and pressure gauge thereof for maintaining an optimum crude oil recovery pressure above the in place crude oil's critical bubble point pressure, for in place crude oil recovery through said enlarged diameter liquid displacer tool and into the production tubing string by the enlarged diameter wellbore annulus to production tubing string increased gas pressure differential with select artificial lift as needed assist to the surface;

flowing increased pressure gas production up the tubing to casing wellbore enlarged diameter annulus and out into the surface gas sales line's restricting pressure; and producing increased crude oil recovery through the enlarged diameter liquid displacer tool and into the production tubing string to the surface for maximum in place recovery of crude oil and natural gas.

10. A method for increasing crude oil recovery by a miscible gas injection procedure directly into one or more downhole opened liquid hydrocarbon formation(s), the method comprising:

providing an enlarged diameter vertical wellbore annulus using expandable liner procedures, within the opened liquid hydrocarbon formation (s), said opened liquid hydrocarbon formation (s) containing in place crude oil;

providing a production tubing string from a surface wellhead down the enlarged diameter vertical wellbore annulus with an enlarged diameter liquid displacer tool on the bottom of said production tubing string, said enlarged diameter liquid displacer for preventing gases from entering into the production tubing string;

providing a surface compressor for miscible gas injection into the opened liquid hydrocarbon formation;

compressing a choice miscible gas from the surface compressor through the surface wellhead pressure control valve thereof, down the open tubing to casing wellbore annulus into a programmed area of the opened liquid hydrocarbon formation to enter into solution with the in place crude oil, under a given optimal pressure equilibrium and temperature within the miscible flooding front;

establishing desired crude oil solution gas saturation, viscosity reduction, increased fluidity and mobility, by the surface compressor's miscible gas injection;

increasing the crude oil's expulsive force and mobility, to be produced and recovered under a maintained predetermined pressure over the crude oil's critical bubble point pressure level;

maintaining the opened liquid hydrocarbon formation under controlled predetermined pressures with said surface compressor's gas injection forward through the entire miscible gas injection procedure;

ending said miscible gas injection from the surface compressor into the liquid hydrocarbon formation's in place crude oil after programmed solution gas saturation is completed to allow solution gas saturated crude oil inflow into the enlarged diameter vertical wellbore annulus and into said enlarged diameter liquid displacer;

recovering solution gas saturated crude oil, and any condensate, after said miscible gas injection procedure is completed into said programmed area;

providing said enlarged liquid displacer for producing said solution gas saturated crude oil into the production tubing by the enlarged diameter vertical wellbore to tubing pressure differential for efficient production and recovery of solution gas saturated crude oil, and any condensate, while removing any possible entering detrimental waters;

producing formation liquid inflow by enlarged diameter vertical wellbore to production tubing string pressure differential, after the miscible gas injection procedure is ended;

passing liquids on through said enlarged diameter liquid displacer into the production tubing string to the surface;

providing a surface wellhead casing annulus with a pressure control valve and a pressure gauge for producing gas and controlling a selected enlarged diameter vertical wellbore to open liquid hydrocarbon formation recovery pressure after the miscible gas injection procedure is ended;

providing the surface pressure control valve and pressure gauge for maintaining the opened liquid hydrocarbon formation under a selected optimal crude oil recovery pressure over the crude oil's critical bubble point pressure, establishing the liquid hydrocarbon recovery period;

producing the opened liquid hydrocarbon formation liquid inflow through said liquid displacer into the production tubing string completely on to the surface by wellbore annulus to production tubing string pressure differential;

maintaining the opened liquid hydrocarbon formation under a controlled enlarged diameter vertical wellbore annulus to liquid hydrocarbon formation pressure above that of the in place crude oil's critical bubble point pressure, with the surface wellhead pressure control valve thereof, forward through the entire liquid hydrocarbon production and recovery process; and using any specially selected or developed select artificial lift when the enlarged diameter vertical wellbore annulus to production tubing string pressure differential through the enlarged diameter liquid displacer tool cannot lift incoming liquids completely to the surface.

11. The method as defined in claim 10, wherein using any select artificial lift, further comprises:

providing one or more gas lift valves optimally spaced up hole on the production tubing string above said liquid displacer to help lift liquids to the surface, said gas lift valves selectively injecting wellbore annulus gasses into the production tubing string for lifting columns of incoming liquids through the production tubing string to the surface; assisting the enlarged diameter liquid displacer's pressure differential liquid lift by helping level by level gas lift the incoming high volume of liquids on to the surface, whereby, assisting said enlarged diameter liquid displacer's pressure differential liquid lift up through the production tubing string toward the surface.

12. The method as defined in claim 10, wherein the vertical wellbore is provided with connecting horizontal or deviated wellbores, which selectively are made into a larger outside diameter by expandable liner procedures for an increased exposure area to the in place liquid hydrocarbons for increased volume recovery area of said liquid hydrocarbons, and for an enlarged size outside diameter liquid displacer, said enlarged size liquid displacer for higher daily liquid volume production at higher operating pressures;

providing the enlarged liquid displacer with increased diameter float size with increased float closing buoyancy, for opening and closing a double shutoff valve's pilot valve inside the float in the enlarged liquid displacer, at higher operating pressures, and with a larger diameter discharge tube for less liquid flow friction in the enlarged liquid displacer, at higher maintained operating pressure differentials between the wellbore annulus and the vertical production tubing string, for increased higher volume and pressure recovery of natural gas and any liquid hydrocarbons; and providing selectively the vertical wellbore with an expandable sand screen for vertical wellbore filtration of any formation sands entering the liquid displacer, for sand screened increased exposure area to the in place liquid hydrocarbons, for sand filtered increased volume area recovery of liquid hydrocarbons.

13. The method as defined in claim 12, further comprising:

injecting water down structure into the liquid hydrocarbon formation as a means for increasing pressure up structure for water drive compressing the in place liquid hydrocarbons, out to the expanded enlarged wellbores for additional enhanced recovery of said in place liquid hydrocarbons, thereby obtaining total in place liquid hydrocarbon recovery.

14. A method for increasing crude oil recovery by a miscible gas injection procedure drawing natural gas from a downhole opened liquid hydrocarbon formation's upper gas cap, the method comprising:

providing an enlarged diameter vertical wellbore annulus within an opened liquid hydrocarbon formation using enlarged expandable liner procedures, said opened liquid hydrocarbon formation having an opened gas cap and containing in place crude oil and natural gas respectively;

providing a surface compressor for drawing natural gas from said liquid hydrocarbon formation's upper gas cap and for reinjecting said natural gas as a select miscible gas down into the liquid hydrocarbon formation, and for injecting an outside source of miscible gas into said liquid hydrocarbon formation and a choice pressurizing gas into the gas cap when gas cap gas is lacking gas pressure and volume availability;

providing a production tubing string from a surface wellhead down the vertical wellbore with one or more predetermined spaced wire line operated dummy plugged gas lift valves on mandrels, and with a wire line operated open sliding sleeve by the opened liquid hydrocarbon formation, and with an enlarged diameter liquid displacer on the bottom of said production tubing string, the enlarged diameter liquid displacer for preventing gasses from passing into the production tubing string, said enlarged liquid displacer for producing formation liquid inflow by vertical wellbore to production tubing pressure differential, when the crude oil recovery period begins;

providing said enlarged diameter liquid displacer for passing liquids on into the production tubing string to the surface; providing the vertical wellbore with a larger outside diameter by expandable liner application procedures for an increased exposure area to the in place liquid hydrocarbons for an increased exposed volume recovery area of said liquid hydrocarbons, and for the increased outside diameter liquid displacer, for increased higher volume and pressure recovery of liquid hydrocarbons;

providing the enlarged diameter vertical wellbore selectively with an expandable sand screen for vertical and horizontal wellbore sand filtration of liquids entering the liquid displacer;

providing the surface wellhead with a pressure control valve and a pressure gauge for passing gas cap gas into the surface compressor and later on controlling a selected optimum wellbore annulus to open liquid hydrocarbon formation liquid hydrocarbon recovery pressure;

providing a packer on said production tubing string with an dummy plugged gas lift valve on a mandrel below it, said packer separating the opened liquid hydrocarbon formation at a adjustable optimal level from said liquid hydrocarbon formation's upper opened gas cap in the vertical tubing to casing wellbore annulus in order to optionally inject a separate choice pressuring gas into the gas cap as needed during gas injection and oil recovery periods;

drawing natural gas off the opened liquid hydrocarbon formation's gas cap above the packer, through the vertical wellbore annulus through the wellhead pressure control valve thereof, and into the surface compressor and re-injecting said natural gas at a selected optimal pressure and temperature from said surface compressor down the tubing string and out the open sliding sleeve directly into the opened liquid hydrocarbon formation containing in place crude oil below the packer;

compressing said natural gas as a miscible flooding front into a programmed area of the liquid hydrocarbon formation to contact and enter solution with the in place crude oil, as the liquid hydrocarbon formation's own compatible miscible gas;

establishing desired crude oil solution gas saturation, viscosity reduction, increased fluidity and mobility, by the surface compressor's miscible natural gas compression thereby increasing the crude oil's expulsive force and mobility through the formations own miscible gas going into solution with the formations own crude oil, to be produced and recovered under a maintained predetermined pressure over the crude oil's critical bubble point pressure level;

optionally injecting a separate choice pressuring gas into the gas cap separated by the packer from the liquid hydrocarbon formation as needed for gas cap gas drive during the miscible gas injection period; and maintaining the opened liquid hydrocarbon formation under controlled predetermined pressures with said surface compressor gas injection forward through the entire miscible gas injection procedure.

15. The method as defined in claim 14, wherein the miscible gas injection procedure is converted for producing and recovering solution gas saturated crude oil, after said miscible gas injection procedure is completed, further comprising:

ceasing said miscible gas injection from the surface compressor into the liquid hydrocarbon formation's in place crude oil after programmed solution gas saturation is completed;

closing the sliding sleeve on the production tubing string to allow maximum crude oil and any other liquids inflow into said enlarged diameter vertical wellbore annulus and into the enlarged diameter liquid displacer;

removing the dummy plug from said dummy plug's gas lift valve mandrel below the packer with a wire line and installing a real casing pressure operated gas lift valve;

providing a gas vent assembly below said packer to maintain a selected optimum pressure in the lower wellbore annulus above the crude oil's critical bubble point pressure level;

providing said enlarged diameter liquid displacer for injecting liquids into the production tubing by enlarged diameter vertical wellbore to tubing pressure differential, for efficient production and recovery of crude oil and any other liquids on to the surface;

injecting optionally a separate choice pressuring gas into the gas cap separated by the packer from the liquid hydrocarbon formation as needed for optimum cap gas drive during the crude oil recovery period;

producing the opened liquid hydrocarbon formation liquid inflow through said enlarged diameter liquid displacer into the production tubing string completely on to the surface by the enlarged diameter vertical wellbore annulus to production tubing string pressure differential; and maintaining the opened liquid hydrocarbon formation under controlled optimum wellbore annulus to liquid hydrocarbon formation pressures above that of the in place crude oil's critical bubble point pressure with the packer and the gas vent assembly thereof, forward through the liquid hydrocarbon production and recovery process.

16. The method as defined in claim 15, wherein the packer and gas vent assembly are removed so that full surface control of the enlarged diameter vertical wellbore annulus to the opened liquid hydrocarbon formation may be attained, further comprising;

providing the surface wellhead's pressure control valve and the pressure gauge thereof, for controlling a selected enlarged diameter wellbore annulus to open liquid hydrocarbon formation liquid hydrocarbon recovery pressure;

producing the opened liquid hydrocarbon formation liquid hydrocarbon and any water inflow through said liquid displacer into the production tubing string completely on to the surface by enlarged diameter wellbore annulus to production tubing string pressure differential alone; and maintaining the opened liquid hydrocarbon formation under controlled optimum wellbore annulus to liquid hydrocarbon formation pressures above that of the in place crude oil's bubble point pressure, with the surface wellhead pressure control valve thereof, forward through the entire liquid hydrocarbon production and recovery process.

17. The method as defined in claim 16, wherein the enlarged diameter wellbore annulus to production tubing string pressure differential through the enlarged liquid displacer cannot lift incoming liquids completely to the surface, and select artificial lift is added, further, comprising:

removing the one or more predetermined spaced dummy plugs from gas lift valve mandrels and providing one or more real gas lift valves optimally spaced up hole on the production tubing string above said liquid displacer for lifting columns of incoming liquids through the production tubing string to the surface;

creating a more efficient gas to liquid interface and sweeping action when the bottom gas lift valve opens, to help level by level gas lift the incoming liquids on to the surface.

18. The method as defined in claim 17, further, comprising:

assisting the enlarged diameter liquid displacer's pressure differential liquid lift by helping level by level gas flow the incoming high volume of liquids on to the surface, whereby, assisting said liquid displacer's pressure differential liquid lift up through the production tubing string toward the surface; and recovering the opened liquid hydrocarbon formation liquid inflow through said enlarged diameter liquid displacer into the production tubing string on to the surface by wellbore annulus to production tubing string pressure differential and artificial lift assist, thereby producing the incoming high volume of liquids on to the surface.

19. The method as defined in claim 15, wherein the method of recovering solution gas saturated crude oil liquid inflow production through the enlarged diameter liquid displacer into the production tubing string by enlarged diameter wellbore annulus to production tubing string pressure differential is substantially enhanced to provide total in place liquid hydrocarbon recovery, further comprising:

injecting water down structure into the liquid hydrocarbon formation as a means for increasing pressure up structure for water drive compressing the in place liquid hydrocarbons, for additional enhanced recovery of said in place liquid hydrocarbons, thereby obtaining total in place liquid hydrocarbon recovery.

* * * * *